United States Patent [19]

Shuto et al.

[11] Patent Number: 4,720,451

[45] Date of Patent: Jan. 19, 1988

[54] SILVER HALIDE COLOR REVERSAL LIGHT-SENSITIVE MATERIAL

[75] Inventors: Sadanobu Shuto; Naoyasu Deguchi, both of Kanagawa, Japan

[73] Assignee: Fuji Photo Film Co., Ltd., Kanagawa, Japan

[21] Appl. No.: 777,143

[22] Filed: Sep. 18, 1985

[30] Foreign Application Priority Data

Sep. 18, 1984 [JP] Japan ..... 59-195408

[51] Int. Cl.[4] ..... G03C 7/30; G03C 7/26; G03C 5/50

[52] U.S. Cl. ..... 430/379; 430/544; 430/567; 430/607; 430/611; 430/613

[58] Field of Search ..... 430/567, 544, 551, 379, 430/607, 611, 613, 505

[56] References Cited

U.S. PATENT DOCUMENTS 4,414,306 11/1983 Wey et al. ..... 430/567
4,439,520 3/1984 Kofron et al. ..... 430/567
4,582,786 4/1986 Ikeda et al. ..... 430/567

*Primary Examiner*—Richard L. Schilling
*Attorney, Agent, or Firm*—Sughrue, Mion, Zinn, Macpeak and Seas

[57] ABSTRACT

A silver halide color reversal light-sensitive material comprising a support having thereon at least one red-sensitive emulsion layer, at least one green-sensitive emulsion layer and at least one blue-sensitive emulsion layer, at least one layer of said light-sensitive material comprising (1) an emulsion containing tabular silver halide grains having a diameter/thickness ratio of at least of about 4 and (2) at least one compound represented by the following general formulae (I) to (IV), said tabular silver halide grains being present in amount of at least about 50% of the total projected area of silver halide grains present in the same layer:

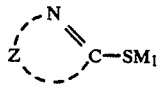

(I)

wherein $M_1$ represents a hydrogen atom, a cation or a group cleavable in alkaline conditions, and Z represents an atomic group as defined in the specification;

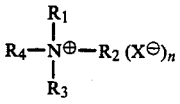

(II)

wherein $R_1$, $R_2$, $R_3$ and $R_4$, which may be the same or different, each represents an alkyl group, an aryl group or an aralkyl group as defined in the specification, $X^{\ominus}$ represents an anion, and n is 1 or is 0 when the compound forms an inner salt;

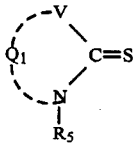

(III)

wherein $R_5$ represents a substituted or unsubstituted alkyl group, a substituted or unsubstituted aralkyl group, a substituted or unsubstituted alkenyl group, a substituted or unsubstituted aryl group or a substituted or unsubstituted heterocyclic group, V represents O, S, Se or $NR_6$ wherein $R_6$ represents an alkyl group, an aralkyl group, an alkenyl group, an aryl group or a heterocyclic group, which may be the same or different from $R_5$, and $Q_1$ represents an atomic group as defined in the specification; and

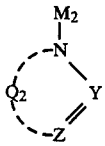

(IV)

wherein Y and Z, which may be the same or different, each represents a methine group, a substituted methine group or a nitrogen atom, $Q_2$ represents an atomic group as defined in the specification, and $M_2$ represents a hydrogen atom or a cation selected from an alkali metal cation and an ammonium ion.

17 Claims, No Drawings

SILVER HALIDE COLOR REVERSAL LIGHT-SENSITIVE MATERIAL

FIELD OF THE INVENTION

The present invention relates to silver halide color reversal light-sensitive materials having improved image sharpness and graininess.

BACKGROUND OF THE INVENTION

Generally, the image sharpness of photographic light-sensitive materials is reduced by increasing the thickness of the emulsion layer because of light scattering by silver halide emulsion grains. Particularly, in multilayer color light-sensitive materials having red-sensitive, green-sensitive and blue-sensitive emulsion layers, light scattering is increased because of the multilayer structure thereof, and reduction of sharpness becomes particularly in the emulsion layer of the lower layer.

U.S. Pat. No. 3,402,046 has disclosed a process for improving sharpness wherein coarse grains having a particle size of 0.7 micron or more which cause less light scattering are used in the blue-sensitive emulsion layer of the uppermost emulsion layer in the multilayer multicolor light-sensitive material.

U.S. Pat. No. 3,658,536 has disclosed a process for improving sharpness wherein one of two blue-sensitive emulsion layers is placed below the green-sensitive emulsion layer or the red-sensitive emulsion layer.

However, these processes have the disadvantage that graininess of the blue-sensitive emulsion layer is increased because of using coarse grains having a larger particle size than that required as the blue-sensitive emulsion grains.

U.S. Pat. No. 4,439,520 has disclosed a color photographic light-sensitive material having improved sharpness, sensitivity and graininess, wherein tabular silver halide grains having a thickness of less than 0.3 micron, a diameter of at least 0.6 micron and a ratio of diameter/thickness (aspect ratio) of 8:1 or more are used in at least one of the green-sensitive emulsion layer and the red-sensitive emulsion layer.

Such a process using tabular silver halide grains for the color photographic light-sensitive materials is excellent from the viewpoint of improving sharpness, sensitivity and graininess, but it is not always satisfactory to use tabular silver halide grains for color reversal light-sensitive materials.

Generally, processing of color reversal light-sensitive materials is carried out by the following steps: black-and-white development (first development)→stopping→water wash→reversing→water wash→color development→stopping→water wash→conditioning bath→water wash→bleaching→fixation→water wash→drying. The first developing solution in these steps contains a silver halide solvent such as KSCN, $Na_2SO_3$, etc. to provide a development acceleration effect by solution physical development. Therefore, in the first development processing step, dissolution of unexposed silver halide grains proceeds to some degree simultaneously with development of exposed silver halide grains, whereby solution physical development is carried out by means of developed silver or colloidal silver in the yellow filter layer.

Silver halide grains remaining without dissolution after the first development are fogged in the reversal bath and contribute to color development. Therefore, when solubility of silver halide grains is high, their contribution in color development is reduced and color density is sometimes reduced. Though silver halide grains generally have a certain distribution of particle size, grains having a comparatively smaller particle size disappear by dissolution when the solubility of silver halide grains is high. Therefore, graininess is increased, because only grains having a large particle size contribute to color development.

Tabular silver halide emulsion grains generally have higher solubility than spherical silver halide grains, because the shape is tabular. Therefore, it is very disadvantageous in practical application to use tabular silver halide grains for color reversal light-sensitive materials because of the above described reason.

SUMMARY OF THE INVENTION

Accordingly, an object of the present invention is to provide a color reversal light-sensitive material comprising tabular silver halide grains, wherein both sharpness and graininess are improved.

The object of the present invention has been attained by providing a silver halide color reversal light-sensitive material having at least one red-sensitive emulsion layer, at least one green-sensitive emulsion layer and at least one blue-sensitive emulsion layer, wherein the light-sensitive material contains (1) an emulsion containing tabular silver halide grains having a diameter of at least about 4 times the thickness thereof and (2) at least one compound represented by the following general formulae (I) to (IV), the tabular grains occupying at least 50% of the total projected area of silver halide grains present in the same layer.

DETAILED DESCRIPTION OF THE INVENTION

In the following, the present invention is illustrated in detail.

General formula (I):

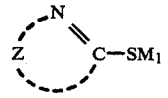

In the formula, $M_1$ represents a hydrogen atom, a cation or a group cleavable in alkaline conditions, and Z represents an atomic group necessary to form a 5-membered or 6-membered heterocycle. The heterocycle may have substituents or may be condensed. In greater detail, $M_1$ represents a hydrogen atom, a cation (e.g., a sodium ion, a potassium ion, and an ammonium ion) or a group cleavable in alkaline conditions (e.g., —COR', —COOR', $—CH_2CH_2COR'$, $—CH_2CH_2CN$, and $—CH_2CH_2SO_2CH_3$, wherein R' represents a hydrogen atom, an alkyl group, an aralkyl group or an aryl group).

Z represents an atomic group necessary to form a 5-membered or 6-membered heterocycle. This heterocycle contains hetero atoms such as a sulfur atom, a selenium atom, a nitrogen atom, and an oxygen atom, and it may be condensed or may have substituents on the heterocycle or the condensed ring.

Examples of Z include tetrazole, triazole, imidazole, oxazole, thiadiazole, pyridine, pyrimidine, triazine, azabenzimidazole, purine, tetrazaindene, triazaindene, pentazaindene, benzotriazole, benzimidazole, benzoxazole, benzothiazole, benzoselenazole, and naphthoimidazole. These rings may be substituted by substituents such as an alkyl group (e.g., a methyl group, an ethyl group, an n-hexyl group, a hydroxyethyl group or a carboxyethyl group), an alkenyl group (e.g., an allyl group), an aralkyl group (e.g., a benzyl group or a phenethyl group), an aryl group (e.g., a phenyl group, a naphthyl group, a p-acetamidophenyl group, a p-carboxyphenyl group, an m-hydroxyphenyl group, a p-sulfamoylphenyl group, a p-acetylphenyl group, an o-methoxyphenyl group, a 2,4-diethylaminophenyl group or a 2,4-dichlorophenyl group), an arylthio group (e.g., a phenylthio group or a naphthylthio group), an alkylthio group (e.g., a methylthio group, an ethylthio group or an n-butylthio group), an aralkylthio group (e.g., a benzylthio group), and a mercapto group. The condensed ring may be substituted by a nitro group, an amino group, a halogen atom, a carboxyl group, or a sulfo group, in addition to the above described substituents.

The compounds represented by the general formula (I) can be synthesized by processes described in E. J. Birr, *Stabilization of Photographic Silver Halide Emulsions,* Focal Press (1974), C. G. Barlow et al., *Reports on the Progress of Applied Chemistry,* 59, 159(1974), and *Research Disclosure,* No. 17643 (December, 1978), or references cited in these literature references.

In the following, preferred examples of compounds represented by the general formula (I) are shown, but the present invention is not limited to them.

(I-1)

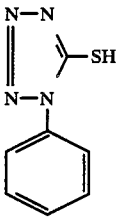

(I-2)

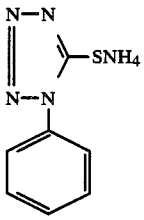

(I-3)

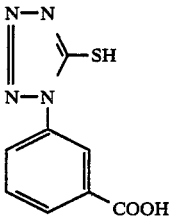

(I-4)

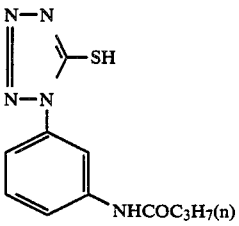

-continued (I-5)

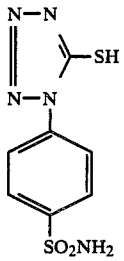

(I-6)

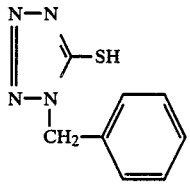

(I-7)

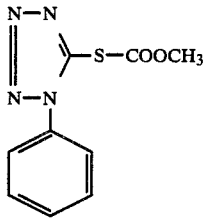

(I-8)

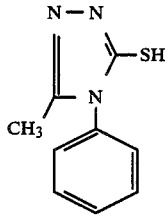

(I-9)

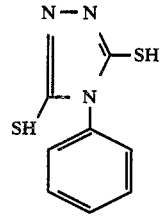

(I-10)

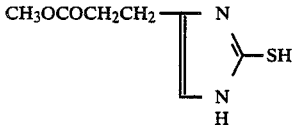

(I-11)

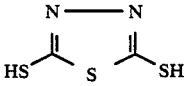

(I-12)

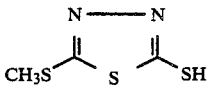

(I-13)

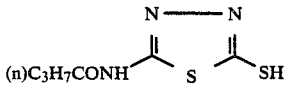

-continued (I-14)

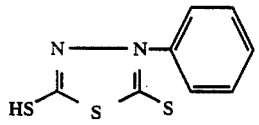

(I-15)

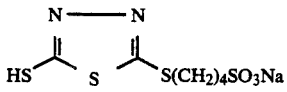

(I-16)

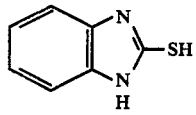

(I-17)

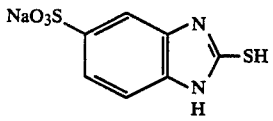

(I-18)

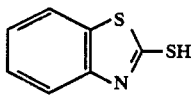

(I-19)

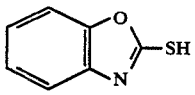

(I-20)

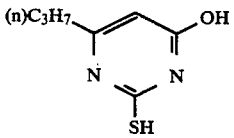

(I-21)

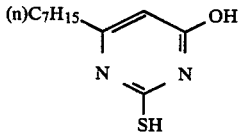

(I-22)

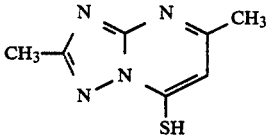

(I-23)

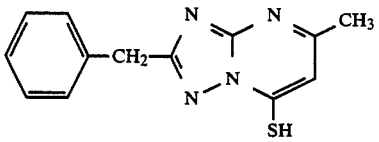

(I-24)

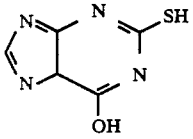

-continued (I-25)

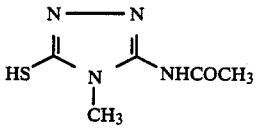

General formula (II)

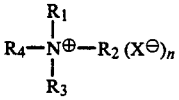

In the formula, $R_1$, $R_2$, $R_3$ and $R_4$, which may be the same or different, each represents an alkyl group, an aryl group or an aralkyl group (but the total number of carbon atoms in $R_1$ to $R_4$ is 6 to 20 and preferably 8 to 12). $R_1$, $R_2$ and $R_3$ may form together a heterocycle containing a quaternary nitrogen atom. Further, $R_1$ and $R_2$ may jointly form a group containing a double bond bonded to the nitrogen atom and then form together $R_3$ a nitrogen-containing ring. $X^{\ominus}$ represents an anion, and n is either 1 or is 0 when the compound forms an inner salt. In greater detail, the alkyl groups of $R_1$ to $R_4$ are those having up to about 30 carbon atoms (e.g., a methyl group, an ethyl group, an n-butyl group, an n-hexyl group or an n-dodecyl group), the aryl groups are those having up to 30 carbon atoms (e.g., a phenyl group, a naphthyl group, a tolyl group or a p-ethylphenyl group), and the aralkyl groups are those having up to 30 carbon atoms (e.g., a benzyl group, or a phenethyl group). $R_1$ to $R_4$ are selected so that the total carbon atom number contained in $R_1$ to $R_4$ is 6 to 20 and preferably 8 to 12.

In the general formula (II), it is most preferred that $R_1$, $R_2$ and $R_3$ form a heterocycle containing a quaternary nitrogen atom together therewith or that $R_1$ and $R_2$ jointly form a group containing a double bond bonded to the nitrogen atom and then form together $R_3$ a nitrogen-containing ring. Namely, compounds represented by the following general formula (IIa) or thereof are preferred.

General formula (IIa)

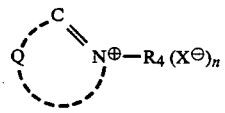

Q represents a quaternary nitrogen containing heterocycle, e.g., a pyridinium ring, a thiazolium ring, a benzothiazolium ring, and a benzimidazolium ring. These rings may be substituted by an alkyl group (e.g., a methyl group, an ethyl group, an n-hexyl group, a hydroxyethyl group or a caboxyethyl group), an alkenyl group (e.g., an allyl group), an aralkyl group (e.g., a benzyl group or a phenethyl group), an aryl group (e.g., a phenyl group, a naphthyl group, a p-acetamidophenyl group, a p-carboxyphenyl group, an m-hydroxyphenyl group, a p-sulfamoylphenyl group, a p-acetylphenyl group, an o-methoxyphenyl group, a 2,4-diethylaminophenyl group or a 2,4-dichlorophenyl group), an alkylthio group (e.g., a methylthio group, an ethylthio group or an n-butylthio group), an arylthio group (e.g., a phenylthio group or a naphthylthio group), or an aralkylthio group (e.g., a benzylthio group). Further, the condensed ring may be substituted by a nitro group, an amino group, a halogen atom, a carboxyl group, or a sulfo group in addition to the above described substituents.

$R_4$, X and n each has the same definition as in general formula (II).

Dimers of the general formula (II) (including general formula (IIa)) are those wherein compounds represented by the general formula (II) are bonded by a divalent group such as an alkylene group or an arylene group.

The compounds represented by the general formula (II) can be synthesized by processes described in G. Hilgetag et al., *Preparation Organic Chemistry,* John Wiley and Sons, Inc. (1972) and S. Patai, *The Chemistry of the Amino Group,* John Wiley and Sons, Inc. (1968).

Preferred examples of the compounds represented by the general formula (II) are shown below, but the present invention is not limited to them.

(II-1)

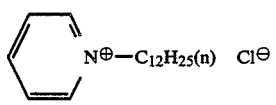

(II-2)

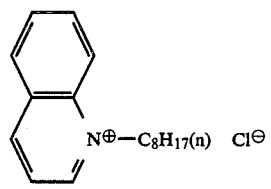

(II-3)

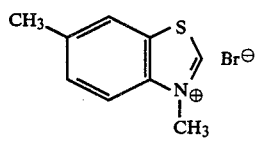

(II-4)

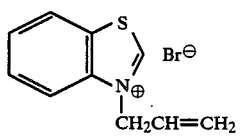

(II-5)

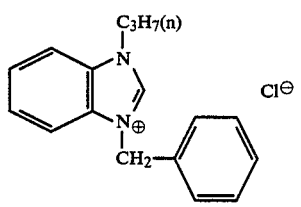

(II-6)

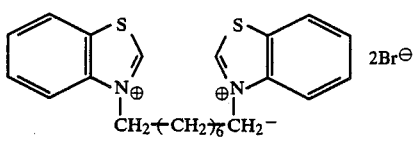

(II-7)

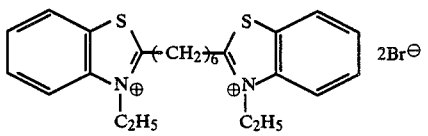

-continued (II-8)

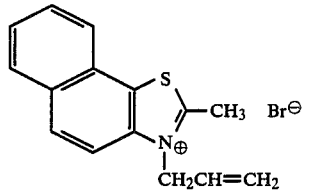

(II-9)

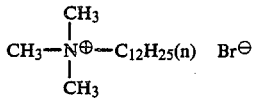

General formula (III)

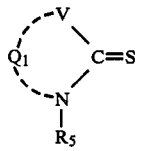

In the formula, $R_5$ represents an unsubstituted or substituted alkyl group, an unsubstituted or substituted aralkyl group, an unsubstituted or substituted alkenyl group, an unsubstituted or substituted aryl group or an unsubstituted or substituted heterocyclic group, V represents O, S, Se or $NR_6$ (wherein $R_6$ represents an alkyl group, an aralkyl group, an alkenyl group, an aryl group or a heterocyclic group, which may be identical to or different from $R_5$), and $Q_1$ represents an atomic group necessary to form a 5- or 6-membered heterocycle which may be condensed.

The alkyl groups represented by $R_5$ and $R_6$ are preferably those having about 1 to 20 carbon atoms which may be substituted. Examples of substituents include halogen atoms (e.g., a chlorine atom), a cyano group, a carboxyl group, a hydroxy group, an acyloxy group having about 2 to 6 carbon atoms (e.g., an acetoxy group), alkoxycarbonyl groups having about 2 to 22 carbon atoms (e.g., an ethoxycarbonyl group or a butoxycarbonyl group), a carbamoyl group, a sulfamoyl group, a sulfo group, an amino group, and a substituted amino group. Preferable examples of the alkyl groups are as follows: methyl group, ethyl group, propyl group (n- or iso-), butyl group (n-, iso- or t-), amyl group, hexyl group, octyl group, dodecyl group, pentadecyl group, heptadecyl group, chloromethyl group, 2-chloroethyl group, 2-cyanoethyl group, carboxymethyl group, 2-carboxyethyl group, 2-hydroxyethyl group, 2-acetoxyethyl group, acetoxymethyl group, ethoxycarbonylmethyl group, butoxycarbonylmethyl group, 2-methoxycarbonylethyl group, benzyl group, o-nitrobenzyl group, and p-sulfobenzyl group, wherein the alkyl moiety may be straight or branched.

Aralkyl groups represented by $R_5$ and $R_6$ include, for example, a benzyl group, a phenethyl group.

Alkenyl groups represented by $R_5$ and $R_6$ include, for example, an allyl group.

Aryl groups represented by $R_5$ and $R_6$ are mononuclear or binuclear aryl groups and, preferably, mononuclear aryl groups, which may be substituted. Examples of substituents include alkyl groups having about 1 to 20 carbon atoms (e.g., a methyl group, an ethyl group or a nonyl group), alkoxy groups having about 1 to 20 carbon atoms (e.g., a methoxy group or an ethoxy group), a hydroxy group, a halogen atom (e.g., a chlorine atom or a bromine atom), a carboxyl group, and a sulfo group. Examples of aryl groups include a phenyl group, a p-tolyl group, a p-methoxyphenyl group, a p-hydroxyphenyl group, a p-chlorophenyl group, a 2,5-dichlorophenyl group, a p-carboxyphenyl group, an o-carboxyphenyl group, a 4-sulfophenyl group, a 2,4-disulfophenyl group, a 2,5-disulfophenyl group, a 3-sulfophenyl group and a 3,5-disulfophenyl group.

Examples of the 5-membered or 6-membered heterocycle formed by $Q_1$ include a thiazoline ring, a thiazolidine ring, a selenazoline ring, an oxazoline ring, an oxazolidine ring, an imidazoline ring, an imidazolidine ring, a 1,3,4-thiadiazoline ring, a 1,3,4-oxadiazoline ring, a 1,3,4-triazoline ring, a tetrazoline ring, and a pyrimidine ring. These heterocycles include those condensed with a 5- to 7-membered carbocycle or heterocycle, including a benzothiazoline nucleus, a naphthothiazoline nucleus, a dihydronaphthothiazoline nucleus, a tetrahydrobenzothiazoline nucleus, a benzoselenazoline nucleus, a benzoxazoline nucleus, a naphthoxazoline nucleus, a benzimidazoline nucleus, a dihydroimidazolopyrimidine nucleus, a dihydrotriazolopyridine nucleus, and a dihydrotriazolopyrimidine nucleus.

These heterocyclic condensation nuclei may have various substituents on the nucleus. In addition to substituents described above as substituents of the aryl groups represented by $R_5$ and $R_6$, substituents include alkylthio groups (e.g., an ethylthio group), unsubstituted or substituted amino groups (e.g., a methylamino group, a diethylamino group, a benzylamino group or an anilino group), acylamino groups (e.g., an acetylamino group or a benzoylamino group), sulfonamido groups (e.g., a methanesulfonamido group or a p-toluenesulfonamido group), thioamido groups (e.g., a propionylthioamido group), alkenyl groups having about 2 to 20 carbon atoms (e.g., an allyl group), aralkyl groups having 1 to 4 carbon atoms in the alkyl moiety (e.g., a benzyl group), a cyano group, carbamoyl groups (including substituted groups, e.g., a methylcarbamoyl group), alkoxycarbonyl groups having about 2 to 22 carbon atoms (e.g., a butoxycarbonyl group), and alkylcarbonyl groups having about 2 to 22 carbon atoms (e.g., a caproyl group).

The above described alkyl groups further include those substituted by a carboxyl group, a sulfo group, an alkoxycarbonyl group, an acyloxy group, and an aryl group.

The compounds represented by the general formula (III) can be synthesized by processes described in Japanese Patent Publication No. 34169/73, *Yakugakuzasshi*, Vo. 74, pages 1365–1369 (1954), Japanese Patent Publication No. 23368/74, *Beilsteins Handbuch der Organische Chemie*, XII, page 394 and IV, page 121 and Japanese Patent Publication No. 18008/72.

In the following, preferred examples of the compounds represented by the general formula (III) are shown, but the the present invention is not limited to them.

(III-1)

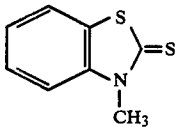

-continued (III-2)

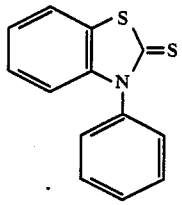

(III-3)

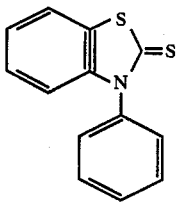

(III-4)

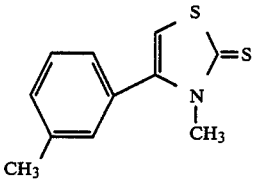

(III-5)

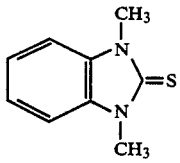

(III-6)

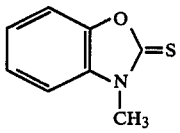

(III-7)

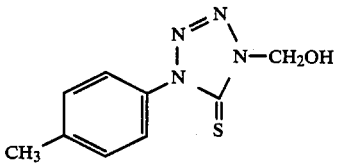

(III-8)

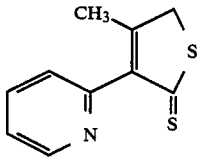

(III-9)

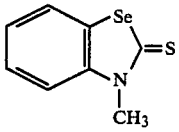

(III-10)

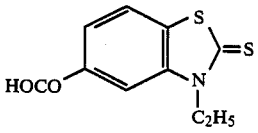

-continued (III-11)

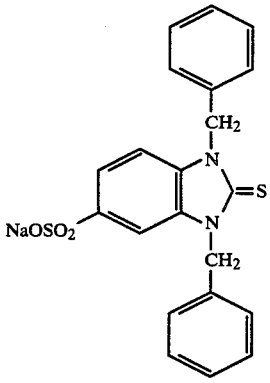

General formula (IV)

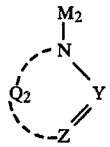

In the formula, Y and Z, which may be the same or different, each represents a methine group, a substituted methine group or a nitrogen atom, and $Q_2$ represents an atomic group necessary to form a 5- or 6-membered heterocycle which may be condensed. $M_2$ represents a hydrogen atom or a cation such as an alkali metal cation or an ammonium ion.

Examples of the ring formed by $Q_2$ include triazole, tetrazole, imidazole, oxazole, thiadiazole, pyridine, pyrimidine, triazine, azabenzimidazole, purine, tetrazaindene, triazaindene, pentazaindene, benzotriazole, benzimidazole, benzoxazole, benzothiazole, benzoselenazole, indazole, and naphthoimidazole.

These rings may be substituted by substituents such as an alkyl group (e.g., a methyl group, an ethyl group, an n-hexyl group, a hydroxyethyl group or a carboxyethyl group), an alkenyl group (e.g., an allyl group), an aralkyl group (e.g., a benzyl group or a phenethyl group), an aryl group (e.g., a phenyl group, a naphthyl group, a p-acetamidophenyl group, a p-carboxyphenyl group, an m-hydroxyphenyl group, a p-sulfamoylphenyl group, a p-acetylphenyl group, an o-methoxyphenyl group, a 2,4-diethylaminophenyl group or a 2,4-dichlorophenyl group), an alkylthio group (e.g., a methylthio group, an ethylthio group or an n-butylthio group), an arylthio group (e.g., a phenylthio group or a naphthylthio group), and an aralkylthio group (e.g., a benzylthio group). Further, the condensed ring may be substituted by a nitro group, an amino group, a halogen atom, a carboxyl group, or a sulfo group in addition to the above described substituents.

The compounds represented by the general formula (IV) can be synthesized by processes described in U.S. Pat. Nos. 2,131,038, 2,334,864, 2,425,774, 2,500,110, and 2,694,716.

Preferred examples of the compounds represented by the general formula (IV) are shown below, but the present invention is not limited to them.

(IV-1)

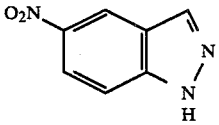

-continued (IV-2)

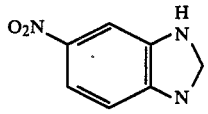

(IV-3)

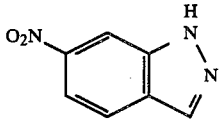

(IV-4)

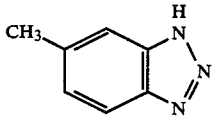

(IV-5)

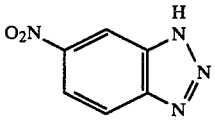

(IV-6)

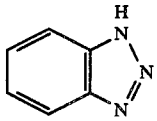

(IV-7)

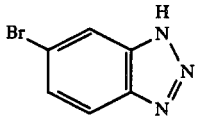

(IV-8)

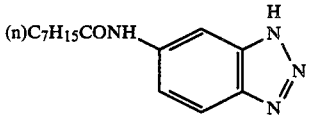

(IV-9)

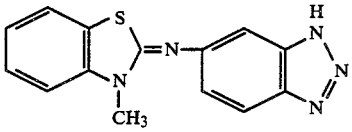

(IV-10)

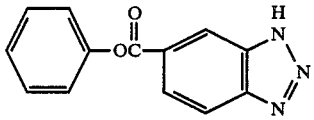

(IV-11)

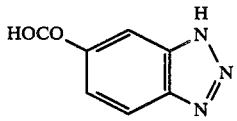

(IV-12)

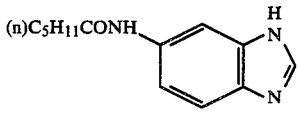

(IV-13)

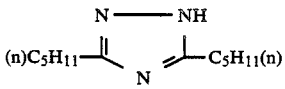

-continued

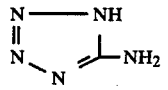

(IV-14)

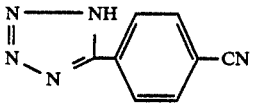

(IV-15)

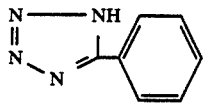

(IV-16)

Compounds represented by the general formulae (I)–(IV) of the present invention are generally used in the same layer as the tabular silver halide emulsion of the present invention. That is, the compounds may be used in adjacent layers to the silver halide emulsion layer, but are preferably used in the silver halide emulsion layer. The total amount of the compounds (I) to (IV) of the present invention used is generally in a range of about $10^{-5}$ to $10^{-1}$ mols, preferably about $10^{-4}$ to $10^{-2}$ mols per mol of tabular silver halide of the present invention.

The compounds represented by the general formulae (I) to (IV) of the present invention may be used alone or two or more of them may be used together.

When mixing the compounds represented by the general formulae (I) to (IV) with the above described tabular silver halide emulsion, it is desirable to mix them in such a manner that the above described compounds are absorbed only on the surface of silver halide emulsion grains. Accordingly, when the tabular silver halide emulsion is incorporated in a red-sensitive, green-sensitive or blue-sensitive silver halide emulsion layer, it is preferred to previously add the compounds of the present invention to the tabular silver halide emulsion. However, the compounds of the present invention may be added to a coating solution containing the tabular silver halide emulsion just before application thereof. The compounds of the present invention may also be added during the formation of tabular silver halide emulsion grains. Moreover, the compounds of the present invention can be also used in case that silver halide other than the tabular silver halide is used.

Of the compounds represented by the general formulae (I) to (IV) of the present invention, particularly preferred compounds are those represented by the general formulae (I), (III) and (IV). More preferably, the compounds are those represented by the general formula (I).

In addition to the compounds represented by the general formulae (I)–(IV) of the present invention, compounds represented by the following general formulae (V) or (VI) may be used together therewith.

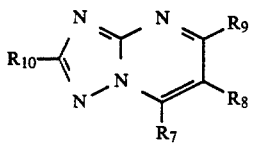

General formula (V)

-continued

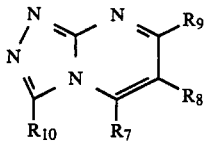

General formula (VI)

In the formulae, $R_7$, $R_8$, $R_9$ and $R_{10}$, which may be the same or different, each represents a hydrogen atom; an unsubstituted or substituted alkyl group having about 1 to 20 carbon atoms which may be cyclic or branched; a monocyclic or bicyclic, unsubstituted or substituted aryl group; an unsubstituted or substituted amino group; a hydroxy group; an alkoxy group having about 1 to 20 carbon atoms; an alkylthio group having about 1 to 6 carbon atoms; a carbamoyl group which may be substituted by an aliphatic group or an aromatic group; a halogen atom; a cyano group; a carboxyl group; an alkoxycarbonyl group having about 2 to 20 carbon atoms; or a 5-membered or 6-membered heterocyclic group having hetero atoms such as a nitrogen atom, an oxygen atom or a sulfur atom. $R_7$ and $R_8$ or $R_8$ and $R_9$ may combine to form a 5-membered or 6-membered ring. However, at least one of $R_7$ and $R_9$ represents a hydroxy group. When $R_{10}$ represents a substituted alkyl group, it may have a heterocycle as the substituent. Substituted alkyl groups represented by the following general formula (VII) are preferred.

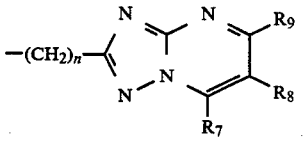

(VII)

$R_7$, $R_8$ and $R_9$ each has the same meaning as defined above, and n represents 2 or 4.

Specific examples of the compounds represented by the general formulae (V) and (VI) are shown below, although the present invention is not to be construed as being limited thereto.

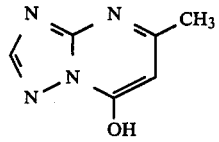

(V-1)

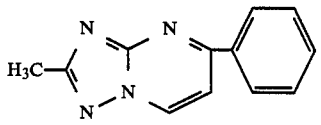

(V-2)

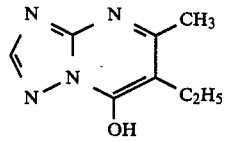

(V-3)

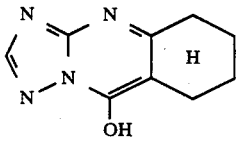

(V-4)

-continued (V-5)

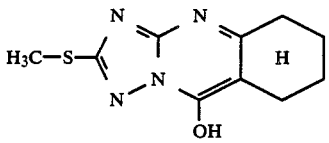

(V-6)

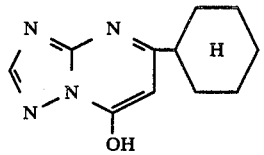

(V-7)

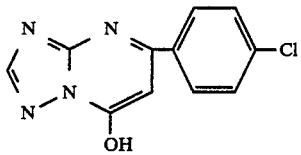

(V-8)

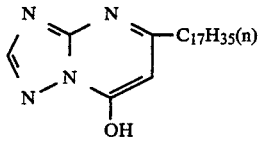

(V-9)

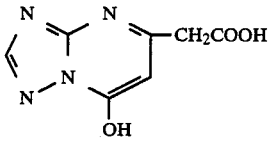

(V-10)

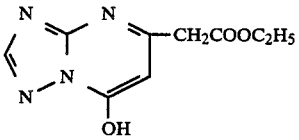

(V-11)

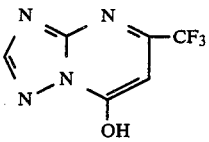

(V-12)

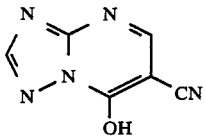

(V-13)

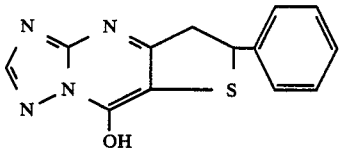

(V-14)

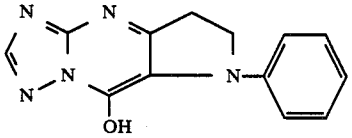

-continued (V-15)

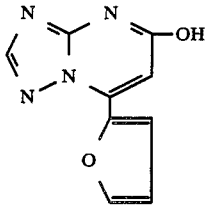

(V-16)

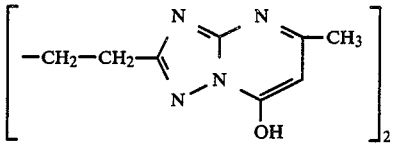

(VI-1)

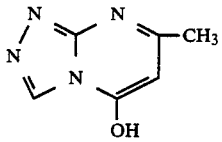

(VI-2)

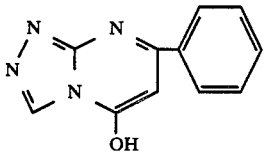

(VI-3)

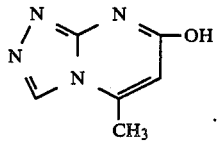

The emulsions containing the tabular silver halide grains used in the present invention are not "autopositive" emulsions, but are negative emulsions.

In the following, the tabular silver halide grains used in the present invention are illustrated.

The tabular silver halide grains used in the present invention are those wherein the ratio of grain diameter/thickness is about 4 or more and preferably about 7 or less.

Here, the term "diameter" of silver halide grains as used herein means the diameter of a circle which has an area equal to the projected area of the grain. In the present invention, the diameter of tabular silver halide grains is in a range of about 0.4 to 5.0$\mu$, preferably, about 0.8 to 4.0$\mu$.

Generally, the tabular silver halide grain is a plate having two parallel faces. Accordingly, the term "thickness" as used in the present invention is represented by a distance between two parallel faces composing the tabular silver halide grain.

The halogen composition of the tabular silver halide grains may be any of silver bromide, silver iodide, silver iodobromide, silver chlorobromide, silver chloroiodobromide and silver chloride, but silver bromide and silver iodobromide are preferred. Silver iodobromide having a silver iodide content of about 0 to 30% by mol is particularly preferred.

The preparation of the tabular silver halide grains can be carried out by suitably combining processes known in this field of the art.

For example, they can be obtained by a process which comprises forming seed crystals wherein tabular grains are present in an amount of 40% by weight or more in a solution having a comparatively low pBr of 1.3 or less, and growing the seed crystals by simultaneously adding silver and halogen solutions while keeping the pBr at the above-described value.

In the step of growing grains, it is desired to add the silver and halogen solutions so as not to form fresh crystal nuclei.

The size of tabular silver halide grains can be adjusted by controlling temperature, selecting the kind and the amount of the solvent, controlling the addition rate of the silver salt and the halide used for growing grains, and by other conventional means.

In preparation of the tabular silver halide grains of the present invention, it is possible to control the particle size, shape of grains (ratio of diameter/thickness, etc.), distribution of particle size and growth rate of grains by using, if desired, silver halide solvent. The amount of the solvent used is preferred to be in a range of about $10^{-3}$ to 1.0% by weight, particularly $10^{-2}$ to $10^{-1}$% by weight, based on the reaction solution.

For example, when the amount of the solvent is increased, the distribution of particle size becomes uniform, i.e., a "monodispersed" and the growth rate can be increased. On the other hand, the thickness of grains tends to increase with an increase in the amount of the solvent used.

Silver halide solvents frequently used include ammonia, thioethers, and thioureas, etc. Thioethyers are disclosed in U.S. Pat. Nos. 3,271,157, 3,790,387 and 3,574,628.

These silver halide solvents are added during preparation of the tabular silver halide grains of the present invention in order to increase the growth of grains. Methods of increasing the rate of addition, the amount of addition and the concentration of a silver salt solution (e.g., an aqueous solution of $AgNO_3$) and a halide solution (e.g., an aqueous solution of KBr) are suitably used.

Typical methods, are disclosed in British Pat. No. 1,335,925, U.S. Pat. Nos. 3,672,900, 3,650,757 and 4,242,445, and Japanese Patent Applications (OPI) Nos. 142329/80, 158124/80, 113927/83, 113928/83, 111934/83 and 111936/83. (The term "OPI", as used herein, refers to a "published unexamined Japanese patent application".)

The tabular silver halide grains of the present invention can be chemically sensitized, if desired.

Chemical sensitization can be carried out by the gold sensitization process using a gold compound (e.g., that disclosed in U.S. Pat. Nos. 2,448,060 and 3,320,069), a sensitization process using metals such as iridium, platinum, rhodium or palladium (disclosed in, e.g., U.S. Pat. Nos. 2,448,060, 2,566,245 and 2,566,263), a sulfur sensitization process using a sulfur containing compound (disclosed in, e.g., U.S. Pat. No. 2,222,264) or a reduction sensitization process using tin salts or polyamines (e.g., described in e.g., U.S. Pat. Nos. 2,487,850, 2,518,698 and 2,521,925), or a combination of two or more of them.

Particularly, in the viewpoint of highly sensitizing the tabular silver halide grains of the present invention, gold sensitization, sulfur sensitization or a combination of them is suitably used.

In the layer containing tabular silver halide grains of the present invention, the tabular grains having a ratio of diameter/thickness of about 4 or more necessarily are present in an amount of about 50% or more based on the total projected area of silver halide grains present in the layer, and it is preferred that the layer contains tabular grains having a ratio of diameter/thickness of about 5 or more which occupy about 50% or more of the total projected area of silver halide grains present in the layer. It is particularly desirable that the tabular grains having a diameter/thickness of about 5 or more is present in an amount of about 50% or more of the total projected area of silver halide grains contained in the layer and that tabular grains having a diameter/thickness of about 8 or more are present in an amount of up to about 50% of the total projected area.

The layer containing tabular silver halide grains is preferred to have a thickness in an range of about 0.3 to 6.0μ, preferably about 0.5 to 4.0μ.

The coating amount of tabular silver halide grains is preferably in a range of about 0.1 to 6 g/m$^2$, particularly, about 0.3 to 3 g/m$^2$.

The silver halide color reversal light-sensitive materials of the present invention have at least one red-sensitive emulsion layer, at least one green-sensitive emulsion layer and at least one blue-sensitive emulsion layer, but the order of the light-sensitive layers is not particularly restricted and can be suitably decided according to the purpose.

Further, as described below, dye forming couplers are used in the silver halide color reversal light-sensitive materials of the present invention. Ordinarily, a cyan dye forming coupler is used for the red-sensitive layer, a magenta dye forming coupler is used for the green-sensitive layer and a yellow dye forming coupler is used for the blue-sensitive layer, but other combinations can be used according to purpose.

The tabular silver halide emulsion in the present invention may be used for any of the above described red-sensitive layer, green-sensitive layer and blue-sensitive layer. When these color-sensitive layers are composed of two or more light-sensitive layers, the emulsion may be used for any layer thereof, but it is particularly preferred to use the tabular silver halide emulsion in the farthest layer from the support. Further, it is preferred that the layer containing the tabular silver halide emulsion has the highest sensitivity of any layers having the same color-sensitivity.

The effect of the present invention is most pronounced when the tabular silver halide emulsion is added to the blue-sensitive layer (the farthest layer from the support when two or more blue-sensitive layers are present) and the blue-sensitive layer is placed at the outermost position with respect to the support as compared with the other color-sensitive layers.

Processing of the color reversal light-sensitive materials of the present invention is carried out, as be described above, by steps of black-and-white development (first development)→stopping→water wash→reversing→water wash→color development→stopping→water wash→conditioning bath→water wash→bleaching→water wash→fixation→water wash→stabilization→drying. In this process, a pre-bath a prehardening bath, and a neutralizing bath, may be used, and the water wash after stopping, reversing, color development, conditioning bath or bleaching may be omitted. Reversing may be carried out in a fogging bath or may be carried out by reexposure to light. The reversing can be omitted by adding a fogging agent to the color development bath. The conditioning bath can be omitted, if desired.

In the first developing solution used in the present invention, any known black-and-white developing agents can be used, including dihydroxybenzenes (e.g., hydroquinone), 3-pyrazolidones (e.g., 1-phenyl-3-pyrazolidone), aminophenols (e.g., N-methyl-p-aminophenol), 1-phenyl-3-pyrazolines, ascorbic acid, heterocyclic compounds wherein a 1,2,3,4-tetrahydroquinoline ring is fused to an indolenine ring as described in U.S. Pat. No. 4,067,872, and the like, which can be used alone or in combination.

The black-and-white developing solution used in the present invention may contains, if desired, conventionally used preservatives (e.g., sulfites or bisulfites), buffering agents (e.g., carbonates, borates, boric acid or alkanolamines), alkali agents (e.g., hydroxides or carbonates), dissolution aids (e.g., polyethylene glycols or esters thereof), pH controlling agents (e.g., organic acids such as acetic acid), sensitizers (e.g., quaternary ammonium salts), development accelerators, surfactants, toning agents, defoaming agents, hardeners or viscosity imparting agents.

In the first developing solution used in the present invention, a compound which functions as a silver halide solvent should be incorporated. Usually, the above-described sulfites added as preservatives also act as the solvent. Specific examples of the sulfites and other silver halide solvents which can be used include KSCN, NaSCN, $K_2SO_3$, $Na_2SO_3$, $K_2S_2O_5$, $Na_2S_2O_5$, $K_2S_2O_3$ and $Na_2S_2O_3$.

In order to accelerate the development, a development accelerator is used. Particularly, compounds represented by the following general formula (VII) described in Japanese Patent Application (OPI) No. 63580/82 are used alone or in combination, and the above described silver halide solvents may be used together with them.

General formula (VII):

$$R'—(S—R)_d—S—R'$$

wherein R represents an alkylene group having 2 to 10 carbon atoms which may contain an ether bond; R' represents an alkyl group having 2 to 10 carbon atoms which may have a substituent or may contain an ether bond or an ester bond; and d represents an integer of 0 to 3.

Although a suitable amount of these silver halide solvents should be used because too small an amount causes delay of development and too large an amount causes fogging on the silver halide emulsion, the suitable amount can be easily determined by persons skilled in the art.

For example, it is preferred to use $SCN^-$ in a range of about 0.005 to 0.02 mol, preferably about 0.01 to 0.015 mol and $SO_3^{2-}$ in a range of about 0.05 to 1 mol, preferably about 0.1 to 0.5 mols, per liter of the developing solution.

When compounds represented by the general formula (VII) are added to the black-and-white developing solution used in the present invention, the amount thereof is preferred to be in a range about of $5\times10^{-6}$ mol to $5\times10^{-1}$ mol, more preferably about $1\times10^{-4}$ mol to $2\times10^{-1}$ mol, per liter of the developing solution.

The pH of the developing solution prepared as described above is selected so as to give the desired density and contrast, but it is preferred to be in a range of about 8.5 to about 11.5.

In order to carry out sensitization processing with the first developing solution, the processing time is extended to at most about 3 times the standard processing time. In this case, when the processing temperature is raised, prolonged processing time for the sensitization processing can be shortened.

The fogging bath used in the present invention may contain known fogging agents, including stannous ion complex salts such as a stannous ion-organophosphoric complex salt (disclosed in U.S. Pat. No. 3,617,282), a stannous ion-organic phosphonocarboxylic complex salt (described in Japanese Patent Publication No. 32616/81), and a stannous ion-aminopolycarboxylic complex salt (described in British Pat. No. 1,209,050), and boron compounds such as boron hydride compounds (disclosed in U.S. Pat. No. 2,984,567) and heterocyclic amine borane compounds (described in British Pat. No. 1,011,000). The fogging bath (reversal bath) can vary in pH over a wide range from acid to alkaline, i.e., in a range of about 2 to 12, preferably about 2.5 to 10, more preferably about 3 to 9.

The color developing solution used in the present invention is a conventional color developing solution containing an aromatic primary amine developing agent. Preferred examples of the aromatic primary amine color developing agents are p-phenylenediamine derivatives, including, e.g., N,N-diethyl-p-phenylenediamine, 2-amino-5-diethylaminotoluene, 2-amino-5-(N-ethyl-N-laurylamino)toluene, 4-(N-ethyl-N-(β-hydroxyethyl)amino)aniline, 2-methyl-4-(N-ethyl-N-(β-hydroxyethyl)amino)aniline, N-ethyl-N-(β-methanesulfonamidoethyl)-3-methyl-4-aminoaniline, N-(2-amino-5-diethylaminophenylethyl)methanesulfonamide, N,N-dimethyl-p-phenylenediamine, and 4-amino-3-methyl-N-ethyl-N-methoxyethylaniline, 4-amino-3-methyl-N-ethyl-N-β-ethoxyethylaniline and 4-amino-3-methyl-N-ethyl-N-β-butoxyethylaniline and salts thereof (e.g., sulfates, hydrochlorides, sulfites, p-toluenesulfonates, etc.) as described in U.S. Pat. Nos. 3,656,950 and 3,698,525.

The color developing solution may further contain other compounds conventionally used as developer compounds. For example, as alkali agents and buffering agents, caustic soda, caustic potash, sodium carbonate, potassium carbonate, sodium tertiary phosphate or potassium tertiary phosphate, potassium metaborate and borax can be used alone or in combination.

To the color developing solution, sulfites (e.g., sodium sulfite, potassium sulfite, potassium bisulfite and sodium bisulfite) or hydroxylamine, which are generally used as preservatives, can be added.

Any development accelerators can be added to the color developing solution, if desired. For example, it is possible to use various pyridinium compounds and other cationic compounds as described in U.S. Pat. No. 2,648,604, Japanese Patent Publication No. 9503/69 and U.S. Pat. No. 3,671,247, cationic dyes such as phenosafranine, neutral salts such as thallium nitrate or potassium nitrate, nonionic compounds such as polyethylene glycol or derivatives thereof or polythioethers, as described in Japanese Patent Publication No. 9504/69 and U.S. Pat. Nos. 2,533,990, 2,531,832, 2,950,970 and 2,577,127, organic solvents or organic amines as described in Japanese Patent Publication No. 9509/69 and Belgian Pat. No. 682,862, ethanolamine, ethylenediamine diethanolamine, and accelerators described in L. F. A. Mason *Photographic Processing Chemistry,* pages 40–43 (Focal Press, London, 1966).

The color developing solution may contain aminopolycarboxylic acids, such as ethylenediaminetetraacetic acid, nitrilotriacetic acid, cyclohexanediaminetetraacetic acid, iminodiacetic acid, N-hydroxymethyl-ethylenediaminetriacetic acid and diethylenetriaminepentaacetic acid, as water softeners.

To the color developing solution, competing couplers or compensating developing agents can be added.

As the competing couplers, citrazinic acid, J-acid or H-acid is useful.

As the compensating developing agents, p-aminophenol, N-benzyl-p-aminophenol or 1-phenyl-3-pyrazolidone can be used.

The pH of the color developing solution is preferred to be in a range of about 8 to 13. The temperature of the color developing solution is selected between about 20° C. and 70° C., but preferably between about 30° C. and 60° C.

The photographic emulsion layers after color development are usually bleached. Bleach processing may be carried out simultaneously with or separately from fixation processing. As bleaching agents, compounds of polyvalent metals, such as iron (III), cobalt (IV), chromium (VI), copper (II), peracids, quinones or nitroso compounds, are used. For example, it is possible to use ferricyanides, bichromates, organic complex salts of iron (III) or cobalt (III) such as complex salts of aminopolycarboxylic acids, e.g., ethylenediaminetetraacetic acid, nitrilotriacetic acid or 1,3-diamino-2-propanoltetraacetic acid, or organic acids, e.g., citric acid, tartaric acid, or malic acid; persulfates and permanganates; and nitrosophenol. Of these, potassium ferricyanide, sodium iorn (III) ethylenediaminetetraacetate and ammonium iron (III) ethylenediaminetetraacetate are particularly useful. Iron (III) aminopolycarboxylate complex salts are useful in both separate bleaching solution and a one-bath bleach-fix solution.

Various additives including bleaching accelerators described in U.S. Pat. Nos. 3,042,520 and 3,241,966 and Japanese Patent Publication Nos. 8506/70 and 8836/70 can be added to the bleaching or bleach-fix solution.

The fixing bath used in the present invention contains a fixing agent such as ammonium, sodium or potassium thiosulfate in an amount of about 30 g/l to about 200 g/l and can additionally contain stabilizers such as sulfites, metabisulfites, hardeners such as potash alum, pH buffers such as acetates, borates, phosphates or carbonates, and the like. The pH of the fixing solution ranges from about 3 to 10, preferably from about 5 to 9.

Other constituents in the layer containing tabular silver halide grains of the present invention, e.g., binders, hardeners, antifoggants, stabilizers for silver halide, surface active agents, spectral sensitizing dyes, dyes, ultraviolet light absorbents, chemical sensitizers, and other conventional agents are not particularly restricted and their incorporation and use are described, for example, in *Research Disclosure,* Vol. 176, pages 22 to 28 (December 1978).

The emulsion layer containing tabular silver halide grains of the present invention or other emulsion layers may contain conventional silver halide grains other than tabular silver halide grains. The average grain size (defined as grain diameter in case of spherical or nearly spherical grains, and edge length in case of cubic grains, which are shown as an average based on the projected area) of conventional silver halide grains in these photographic emulsions is not particularly restricted, but it is preferably about 3μ or less. Grain size distribution can be either narrow or broad.

Conventional silver halide grains used in the photographic emulsions of the present invention may have a regular crystal form such as cube or octahedron, or an irregular crystal form such as sphere or table, or may have a mixed crystal form of them. They may be composed of a mixture of grains having different crystal forms.

These photographic emulsions can be prepared by the processes described in P. Glafkides, *Chimie et Physique Photographique* (Paul Montel, 1967), G. F. Duffin, *Photographic Emulsion Chemistry,* (The Focal Press, 1966), and V. L. Zelikman et al, *Making and Coating Photographic Emulsion,* (The Focal Press, 1964). Namely, any of any acid process, a neutral process and an ammonia process can be used. As a method of reacting soluble silver salts with soluble halogen salts, any of a one-side mixing process, a simultaneous mixing process and a combination of them may be used.

A process for forming grains in the presence of excess silver halide ions (the "back mixing" process) can be used. As an example of the simultaneous mixing process, a process wherein the pAg in the liquid phase in which silver halide is formed is kept constant, i.e., the "controlled double jet" process, can be used.

According to this process, a silver halide emulsion having a regular crystal size and a nearly uniform grain size was obtained.

Two or more silver halide emulsions separately prepared may be mixed and used in the emulsion layers of the present invention.

In the step of forming silver halide grains or physical ripening thereof, cadmium salts, zinc salts, lead salts, thallium salts, iridium salts or complex salts thereof, rhodium salts or complex salts thereof, and iron salts or complex salts thereof, may be introduced.

The silver halide emulsions may be used as "primitive" emulsions, i.e. without chemical sensitization, but are usually chemically sensitized. Chemical sensitization can be carried out according to processes described in the above-described books written by Glafkides or Zelikman et al or in H. Frieser, *Die Grundlagen der Photographischen Prozesse mit Silverhalogeniden* (Akademische Verlagsgesellschaft, 1968).

Namely, a sulfur sensitization process using a surfur containing compound capable of reacting with silver ion or active gelatin, a reduction sensitization process using a reductive substance, a noble metal sensitization process using a compound of gold or other noble metals can be employed alone or in combination. As sulfur sensitizers, thiosulfates, thioureas, thiazoles, rhodanines and other compounds can be used, such as those described in U.S. Pat. Nos. 1,574,944, 2,410,689, 2,278,947, 2,728,668 and 3,656,955. As reduction sensitizers, stannous salts, amines, hydrazine derivatives, formamidinesulfinic acids and silane compounds can be used, such as those described in U.S. Pat. Nos. 2,487,850, 2,419,974, 2,518,698, 2,983,609, 2,983,610 and 2,694,637. For noble metal sensitization, gold complex salts and complex salts of Periodic Group VIII metals such as platinum, iridium and palladium can be used, such as those described in U.S. Pat. Nos. 2,399,083, 2,448,060 and British Pat. No. 618,061.

In the present invention, various color couplers can be used. The terms "color coupler" as used herein means a compound capable of forming a dye by reacting with an oxidation product of an aromatic primary amine developing agent. Typical examples of useful color couplers include naphthol type or phenol type compounds, pyrazolone type or pyrazoloazole type compounds and open-ring or heterocyclic ketomethylene compounds. Specific examples of these cyan, magenta and yellow couplers that can be used in the present invention are described in the patents cited in *Research Disclosure* (RD) 17643 (December 1979) VII-D and 18717 (November 1979).

The color couplers to be incorporated in the light-sensitive materials are preferably antidiffusible couplers which have a ballast group or are polymerized. 2-Equivalent color couplers wherein the coupling active site is substituted by a releasing group are more desirable than 4-equivalent color couplers having a hydrogen atom out the coupling active site. Couplers which form a dye having suitable diffusibility, noncoloring couplers, DIR couplers which release a development restrainer by a coupling reaction and couplers which release a development accelerator can also be used.

Yellow couplers useful in the present invention include oil protective type acylacetamide couplers such as those described in U.S. Pat. Nos. 2,407,210, 2,875,057 and 3,265,506. In the present invention, 2-equivalent yellow couplers are advantageously used. Typical examples include oxygen atom releasing yellow couplers described in U.S. Pat. Nos. 3,408,194, 3,447,928, 3,933,501, and 4,022,620, and nitrogen atom releasing yellow couplers described in Japanese Patent Publication No. 10739/83, U.S. Pat. Nos. 4,401,752 and 4,326,024, *Research Disclosure* No. 18053 (April 1979), British Pat. No. 1,425,020 and West German Patent Application (OLS) Nos. 2,219,917, 2,261,361, 2,329,587, and 2,433,812. α-Pivaloylacetanilide couplers form a dye having good fastness and, particularly, good fastness to light, while α-benzoylacetanilide couplers give high color density.

Magenta couplers useful in the present invention include oil protective type imidazolone, cyanoacetyl, pyrazolone and pyrazoloazole couplers and, preferably 5-pyrazolone and pyrazolotriazole couplers. As the 5-pyrazolone couplers, those substituted by an arylamino group or an acylamino group at the 3-position are preferred from the viewpoint of hue and color density of the developed dye. Specific examples are described in U.S. Pat. Nos. 2,311,082, 2,343,703, 2,600,788, 2,908,573, 3,062,653, 3,152,896, and 3,936,015. 2-equivalent type 5-pyrazolone couplers are preferred because high color density and high sensitivity are obtained using a smaller coated silver content, and nitrogen atom releasing groups described in U.S. Pat. No. 4,310,619 and arylthio groups described in U.S. Pat. No. 4,351,897 are suitable as releasing groups. Ballast groups described in European Pat. No. 73,636 increase color density in the 5-pyrazolone couplers. Pyrazoloazole couplers include pyrazolobenzimidazoles described in U.S. Pat. No. 3,369,897 and, preferably, pyrazolo(5,1-c)(1,2,4)-triazoles described in U.S. Pat. No. 3,725,067, pyrazolotetrazoles described in *Research Disclosure* No. 24220 (June 1984) and pyrazolopyrazoles described in *Research Disclosure* No. 24230 (June 1984). Imidazo(1,2-b)pyrazoles described in European Pat. No. 119,741 and, particularly, pyrazolo(1,5-b)(1,2,4)-triazole described in European Pat. No. 119,860 are preferred because the developed dye has little yellow sub-absorption and good fastness to light.

Cyan couplers useful in the present invention include oil protective type naphthol and phenol couplers. Specific examples include naphthol couplers described in U.S. Pat. No. 2,474,293 and, preferably, oxygen atom releasing type 2-equivalent naphthol couplers described in U.S. Pat. Nos. 4,052,212, 4,146,396, 4,228,233 and 4,296,200. Specific examples of phenol couplers are described in U.S. Pat. Nos. 2,369,929, 2,801,171, 2,772,162 and 2,895,826.

Cyan couplers having fastness to moisture and temperature are advantageously used. Examples of them include phenol cyan couplers described in U.S. Pat. No. 3,772,002, 2,5-diacylamino substituted phenol couplers described in U.S. Pat. Nos. 2,772,162, 3,758,308, 4,126,396, 4,334,011 and 4,327,173, West German Application (OLS) No. 3,329,729 and Japanese Patent Application No. 32671/83, and phenol couplers having a phenylureido group in 2-position and an acylamino group in 5-position described in U.S. Pat. Nos. 3,446,622, 4,333,99?, 4,451,559 and 4,427,767.

These color couplers may form polymers including dimers. Typical examples of polymerized couplers are described in U.S. Pat. Nos. 3,451,820 and 4,080,211. Specific examples of polymerized magenta couplers are described in Pritish Pat. No. 2,102,173 and U.S. Pat. No. 4,367,282.

Developed dye diffusing type couplers can be used together with the above couplers to improve graininess. Specific examples of such magenta couplers are described in U.S. Pat. No. 4,366,237 and British Pat. No. 2,125,570, and specific examples of magenta and cyan couplers are described in European Pat. No. 96,873 and West German Patent Application (OLS) No. 3,324,533.

The photographic emulsions of the present invention may be spectrally sensitized with methine dyes and the like. Dyes to be used include cyanine dyes, merocyanine dyes, complex cyanine dyes, complex merocyanine dyes, holopolar cyanine dyes, hemicyanine dyes, styryl dyes and hemioxonol dyes. Particularly useful dyes are cyanine dyes, merocyanine dyes and complex merocyanine dyes. In these dyes, any nuclei ordinarily used as the basic heterocyclic group in cyanine dyes can be utilized. Namely, it is possible to use a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus or a pyridine nucleus; nuclei wherein an alicyclic hydrocarbon ring is fused to the above described nuclei; and nuclei wherein an aromatic hydrocarbon ring is fused to the above described nuclei, e.g., an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus or a quinoline nuclues. These nuclei may have substituents on the carbon atoms of the nuclei.

In merocyanine dyes or complex merocyanine dyes, 5- and 6-membered heterocyclic nuclei such as a pyrazolin-5-one nucleus, a thiohydantoin nucleus, a 2-thiooxazolidin-2,4-dione nucleus, a thiazolidin-2,4-dione nucleus, a rhodanine nucleus or a thiobarbituric acid nucleus may be used as ketomethylene structure containing nuclei.

Of these, sensitizing dyes having at least two water-soluble groups are particularly useful. Such dyes are described in Japanese Patent Application No. 10091/83.

These sensitizing dyes may be used alone, but they may be used in combination. Combinations of sensitizing dyes are often used for the purpose of supersensitization. Typical examples of such combinations are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, and Japanese Patent Publication Nos. 4936/68 and 12375/78, and Japanese Patent Application (OPI) Nos. 110618/77 and 109925/77.

The emulsions may contain a dye which does not itself have a spectrally sensitizing effect or a substance which does not substantially absorb visible light but exhibits a supersensitizing effect together with the sensitizing dye.

As binders for each light-sensitive photographic emulsion layer of the present invention, interlayers and other constituent layers, gelatin is advantegeously used, but other hydrophilic colloids can be used. For example, it is possible to use proteins such as gelatin derivatives, graft polymers composed of gelatin and other high polymer, albumin or casein; saccharide derivatives such as cellulose derivativs, e.g., hydroxyethyl cellulose, carboxymethyl cellulose or cellulose sulfate, sodium alginate, starch derivatives, and various synthetic hydrophilic high polymer substances such as homopolymers or copolymers, e.g., polyvinyl alcohol, partial acetal of polyvinyl alcohol, poly-N-vinylpyrrolidone, polyacrylic acid, polymethacrylic acid, polyacrylamide, polyvinylimidazole or polyvinylpyrazole.

As gelatin, acid-processed gelatin or enzyme-processed gelatin as well as lime-processed gelatin may be used. Hydrolyzed products and enzymatic decomposition products of gelatin can be used, too.

In the photographic light-sensitive materials, the photographic emulsion layers and other constituent layers may contain inorganic or organic hardeners. For example, chromium salts (e.g., chromium alum and chromium acetate), aldehydes (e.g., formaldehyde, glyoxal and glutaraldehyde), N-methylol compounds (e.g., dimethylolurea and methyloldimethylhydantoin), dioxane derivatives (e.g., 2,3-dihydroxydioxane), active vinyl compounds (e.g., 1,3,5-triacryloyl-hexahydro-s-triazine and 1,3-vinylsulfonyl-2-propanol), active halogen compounds (e.g., 2,4-dichloro-6-hydroxy-s-triazine), mucohalogenic acids (e.g., mucochloric acid and mucophenoxychloric acid) can be used alone or in combination.

The photographic emulsion layers and other constituent layers of the light-sensitive materials of the present invention may contain various surfactants for various purposes, e.g., as coating aids, for prevention of static buildup, for improvement of slipping properties, for dispersing by emulsification, for prevention of adhesion, and for improvement of photographic properties (e.g., acceleration of development, hard toning, sensitization, etc.).

For example, it is possible to use cationic surfactants such as heterocyclic quaternary ammonium salts (e.g., pyridinium and imidazolium) and aliphatic or heterocyclic phosphonium or sulfonium salts.

The light-sensitive materials of the present invention may contain a developing agent, such as those described in *Research Disclosure,* vol. 176, p. 29, paragraph "Developing Agents".

In the light-sensitive materials according to the present invention, the photographic emulsion layers or other constituent layers may contain dyes as filter dyes or for other various purposes including prevention of irradiation. As such dyes, those described in *Research Disclosure,* vol. 176, pages 25–26, paragraph entitled "Absorbing and Filter Dyes" can be used.

The light-sensitive materials of the present invention may contain antistatic agents, plasticizers, matting agents, lubricants, ultraviolet light absorbents, fluorescent whitening agents, air-fog preventing agents, or other conventional agents.

In the following, the present invention is illustrated in greater detail with reference to specific examples and embodiment thereof, but the present invention is not to be construed as being in any way limited thereto. Unless otherwise indicated, all parts, percents and ratios are by weight.

EXAMPLE 1

A tabular silver halide emulsion was prepared according to the following process.

30 g of gelatin, 10.3 g of potassium bromide and 10 cc of a 0.5 wt% aqueous solution of $HO(CH_2)_2S(CH_2)_2S(CH_2)_2OH$ were added to 1 l of water and the container was kept at 60° C. (pAg 9.1, pH 6.5). After Solutions I and II shown in Table 1 were added at the same time over 15 seconds with stirring, Solutions III and IV were added at the same time over 65 minutes by a double jet process.

During addition of Solutions III and IV, Solution V was simultaneously added over 15 minutes, i.e., Solution V was initiated to add 40 minutes after initiation of the addition of Solutions III and IV.

In the tabular silver halide grains obtained, grains having a ratio of diameter/thickness of 5 or more occupied 50% of the projected area of all silver halide grains present and their silver iodide content was 2.5% by mol. This emulsion was chemically sensitized with gold and surfur, and compound (V-1) was added thereto. The resulting tabular silver halide emulsion was designated as Emulsion A.

TABLE 1

| | Solution I | Solution II | Solution III | Solution IV | Solution V |
|---|---|---|---|---|---|
| $AgNO_3$ (g) | 4.5 | — | 95.5 | — | — |
| $H_2O$ (cc) | 30 | 26.7 | 561 | 542 | 100 |
| KBr (g) | — | 3.15 | — | 69.6 | — |
| KI (g) | — | — | — | — | 2.5 |
| 5 wt % Aqueous solution of $HO(CH_2)_2S(CH_2)_2S(CH_2)_2OH$ (cc) | — | 0.45 | — | 12.5 | — |

For comparison with Emulsion A, spherical grains of silver iodobromide (silver iodide 2.5% by mol) were prepared in the presence of ammonia by a double jet process. The resulting emulsion grains had an average particle size of 0.7 μm. They were chemically sensitized with gold and sulfur, and compound (V-1) was added thereto. The resulting emulsion was designated as Emulsion B.

Onto a triacetate film support were coated the following first to twelfth layers in the order listed below to prepare a color reversal photographic light-sensitive material.

The 1st layer: Antihalation layer (gelatin layer containing black colloidal silver)

The 2nd layer: Gelatin interlayer 2,5-Di-t-octylhydroquinone was dissolved in 100 cc of dibutyl phthalate and 100 cc of ethyl acetate, and the solution was stirred with 1 kg of a 10% aqueous solution of gelatin at a high rate. 2 kg of the resulting emulsion was mixed with 1.5 kg of a 10% solution of gelatin together with 1 kg of a fine grain emulsion (particle size 0.06μ, molar number of silver iodide in silver iodobromide: 1 mol%) which was not chemically sensitized. The resulting emulsion was applied to as to result in a dry film thickness of 2μ (silver amount: 0.4 g/m$^2$).

The 3rd layer: Low-speed red-sensitive emulsion layer 100 g of a cyan coupler, 2-(heptafluorobutyramido)-5-(2'-(2'',4''-di-t-amylphenoxy)butyramido)phenol was dissolved in 100 cc of tricresyl phosphate and 100 cc of ethyl acetate, and the solution was stirred with 1 kg of a 10% aqueous solution of gelatin at a high rate. 500 g of the resulting emulsion was mixed with 1 kg of a red-sensitive silver iodobromide emulsion (which contained 70 g of silver and 60 g of gelatin and had an iodine content of 4 mol%). The resulting mixture was applied so as to result in a dry film thickness of 1μ (silver amount: 0.5 g/m$^2$).

The 4th layer: High-speed red-sensitive emulsion layer 100 g of a cyan coupler, 2-(heptafluorobutyramido)-5-(2'-(2'',4''-di-t-amylphenoxy)butyramido)phenol was dissolved in 100 cc of tricresyl phosphate and 100 cc of ethyl acetate. And the solution was stirred with 1 kg of a 10% aqueous solution of gelatin at a high rate. 1000 g of the resulting emulsion was mixed with 1 kg of a red-sensitive silver iodobromide emulsion (which contained 70 g of silver and 60 g of gelatin and had an iodine content of 2.5 mol %). The resulting mixture was applied so as to result in a dry film thickness of 2.5μ (silver amount: 0.7 g/m$^2$).

The 5th layer: Interlayer 2,5-Di-t-octylhydroquinone was dissolved in a mixture of 100 cc of dibutyl phthalate and 100 cc of ethyl acetate, and the solution was stirred with 1 kg of a 10% aqueous solution of gelatin at a high rate. 1 kg of the resulting emulsion was mixed with 1 kg of a 10% solution of gelatin, and the mixture was applied so as to result in a dry film thickness of 1μ.

The 6th layer: Low-speed green-sensitive emulsion layer 300 g of an emulsion which was prepared in the same manner as the emulsion of the 3rd layer except for using a magenta coupler, 1-(2,4,6-trichlorophenyl)-3-(3-(2,4-di-t-amylphenoxyacetamido)benzamido)-5-pyrazolone instead of the cyan coupler was mixed with 1 kg of a green-sensitive silver iodobromide emulsion (which contained 70 g of silver and 60 g of gelatin and had an iodine content of 3 mol %), and the mixture was applied so as to result in a dry film thickness of 1.3μ (silver amount: 0.7 g/m$^2$).

The 7th layer: High-speed green-sensitive emulsion layer 1000 g of an emulsion which was prepared in the same manner as the emulsion of the 3rd layer except for using a magenta coupler, 1-(2,4,6-trichlorophenyl)-3-(3-(2,4-di-t-amylphenoxyacetamido)benzamido)-5-pyrazolone instead of the cyan coupler was mixed with 1 kg of a green-sensitive silver iodobromide emulsion (which contained 70 g of silver and 60 g of gelatin and had an iodine content of 2.5 mol %), and the resulting mixture was applied so as to result in a dry film thickness of 3.5μ (silver amount: 0.8 g/m$^2$).

The 8th layer: Yellow filter layer

An emulsion containing yellow colloidal silver was applied so as to result in a dry film thickness of 1μ.

The 9th layer: Low-speed blue-sensitive emulsion layer 1000 g of an emulsion which was prepared in the same manner as the emulsion used in the 3rd layer except for using a yellow coupler, α-(pivaloyl)-α-(1-benzyl-5-ethoxy-3-hydantoinyl)-2-chloro-5-dodecyloxycarbonylacetanilide instead of the cyan coupler was mixed with 1 kg of a blue-sensitive silver iodobromide emulsion (which contained 70 g of silver and 60 g of gelatin and had an iodine content of 2.5 mol %), and the resulting mixture was applied so as to result in a dry film thickness of 1.5μ (silver amount: 0.6 g/m$^2$).

The 10th layer: High-speed blue-sensitive emulsion layer 1000 g of an emulsion which was prepared in the same manner as for the emulsion of the 3rd layer except for using a yellow coupler, α-(pivaloyl)-α-(1-benzyl-5-ethoxy-3-hydantoinyl)-2-chloro-5-dodecyloxycarbonylacetanilid instead of the cyan coupler was mixed with 1 kg of the above described spherical silver iodobromide emulsion B (which contained 70 g of silver and 60 g of gelatin and had an iodine content of 2.5 mol %), and the resulting mixture was applied so as to reseult in a dry film thickness of 3μ (silver amount: 1.1 g/m$^2$).

The 11th layer: Second protective layer

A mixture of 15 g of an ultraviolet light absorbent, 5-chloro-2-(2-hydroxy-3,5-di-t-butylphenyl)-2H-benzotriazole, 30 g of 2-(2-hydroxy-5-t-butylphenyl)-2H-benzotriazole, 35 g of 2-(2-hydroxy-3-sec-butyl-5-t-butylphenyl)-2H-benzotriazole and 100 g of dodecyl 5-(N,N-diethylamino)-2-benzenesulfonyl-2,4-pentadienoate was stirred together with 200 ml of tricresyl phosphate, 200 ml of ethyl acetate, 20 g of sodium dodecylbenzenesulfonate and a 10% aqueous solution of gelatin at a high rate. The resulting emulsion was mixed with 10% gelatin, water and a coating aid, and the resulting mixture was applied so as to result in a dry film thickness of 2μ.

The 12th layer: First protective layer

A 10% aqueous solution of gelatin containing an emulsion of fine silver halide grains having the surfaces thereof fogged (particle size: 0.06μ, molar number of silver iodide in silver iodobromide: 1 mol%) was applied so as to result in coated silver amount of 0.1 g/m$^2$ and a dry film thickness of 0.8μ.

The sample prepared as described above was designated as Sample 101, which was used as a comparative sample.

Then, Sample 102 was prepared in the same manner as for Sample 101 except that the tabular emulsion A was used for forming the 10th layer (high-speed blue-sensitive emulsion layer) instead of the spherical emulsion B.

Then, Samples 103 to 112 were prepared in the same manner as Sampel 102 except that compounds of the present invention shown in Table 2 were used together with the above described emulsion A for forming the 10th layer (high-speed blue-sensitive emulsion layer).

The resulted samples were exposed through a pattern for measuring graininessor a pattern for measuring sharpness using white light from a light source of 4800° K. at an illuminance of exposed surface of 1000 luxes, and they were then subjected to the following development processing to obtain positive color images.

The processing steps and processing solutions used were are as follows.

| Processing step | Time | Temperature |
|---|---|---|
| First development | 6 minutes | 38° C. |
| Water wash | 2 minutes | " |
| Reversing | 2 minutes | " |
| Color development | 6 minutes | " |
| Conditioning | 2 minutes | " |
| Bleaching | 6 minutes | " |
| Fixation | 4 minutes | " |
| Water wash | 4 minutes | " |
| Stabilization | 1 minute | Room temperature |
| Drying | | |

The compositions of processing solutions used were as follows.

| | |
|---|---|
| First developing solution: | |
| Water | 700 ml |
| Sodium tetrapolyphosphate | 2 g |
| Sodium sulfite | 20 g |
| Hydroquinone monosulfonate | 30 g |
| Sodium carbonate (monohydrate) | 30 g |
| 1-Phenyl-4-methyl-4-hydroxymethyl-3-pyrazolidone | 2 g |
| Potassium bromide | 2.5 g |
| Potassium thiocyanate | 1.2 g |
| Potassium iodide (0.1% solution) | 2 ml |
| Water to make | 1000 ml (pH 10.1) |
| Reversing solution | |
| Water | 700 ml |
| Nitrilo-N,N,N—trimethylenephosphonic acid.6Na salt | 3 g |
| Stannous chloride (dihydrate) | 1 g |
| p-Aminophenol | 0.1 g |
| Sodium hydroxide | 8 g |
| Glacial acetic acid | 15 ml |
| Water to make | 1000 ml |
| Color developing solution | |
| Water | 700 ml |
| Sodium tetrapolyphosphate | 2 g |
| Sodium sulfite | 7 g |
| Sodium tertiary phosphate (12 hydrate) | 36 g |
| Potassium bromide | 1 g |
| Potassium iodide (0.1% solution) | 90 ml |
| Sodium hydroxide | 3 g |
| Citrazinic acid | 1.5 g |
| N—Ethyl-N—(β-methanesulfonamidoethyl)-3-methyl-4-aminoanilinesulfate | 11 g |
| Ethylenediamine | 3 g |
| Water to make | 1000 ml |
| Conditioning solution | |
| Water | 700 ml |
| Sodium sulfite | 12 g |
| Sodium ethylenediaminetetraacetate (dihydrate) | 8 g |
| Thioglycerine | 0.4 ml |
| Glacial acetic acid | 3 ml |
| Water to make | 1000 ml |
| Bleaching solution | |
| Water | 800 g |
| Sodium ethylenediaminetetraacetate (2 hydrate) | 2.0 g |
| Ammonium ethylenediaminetetraacetato ferrate (III) (dihydrate) | 120.0 g |
| Potassium bromide | 100.0 g |
| Water to make | 1000 ml |
| Fixing solution | |
| Water | 800 ml |
| Sodium thiosulfate | 80.0 g |
| Sodium sulfite | 5.0 g |
| Sodium bisulfite | 5.0 g |
| Water to make | 1000 ml |

-continued

| | |
|---|---|
| Stabilizing solution | |
| Water | 800 ml |
| Formaldehyde (37 wt %) | 5.0 ml |
| Fuji Driwel | 5.0 ml |
| Water to make | 1000 ml |

Graininess of yellow image and sharpness of magenta and cyan images of these processed samples were measured.

Graininess (RMS granularity) was presented as a value which was 1000 times the standard deviation of density variation caused in case of scanning by a microdensitometer. The smaller the value of graininess, the more preferred the properties are.

Sharpness was determined as an MTF value. The higher the value of sharpness, the more preferred the properties are.

RMS values at a density of 1.0 and MTF values at a frequency of 25/mm are shown in Table 2.

The samples were exposed to light and subjected to development processing in the same manner as described above except for using a wedge for sensitometry instead of the pattern for measuring graininess or sharpness. The optical density of the yellow image was measured through a blue filter, and sensitivity was presented as a reciprocal of an exposure amount necessary to obtain a definite yellow density (D=1.0).

The results obtained are shown in Table 2.

It is understood from Table 2 that sharpness in the sample (Sample 102) wherein the tabular emulsion A was used in the high-speed blue-sensitive layer was remarkably improved as compared with the sample (Sample 101) wherein the spherical emulsion B was used in the high-speed blue-sensitive layer. However, the graininess of this sample was inferior to that of comparative sample 101.

In contrast, in samples (Samples 103 to 112) wherein the tabular emulsion A and the compound of the present invention were used together in the high-speed blue-sensitive layer, sharpness was improved without causing deterioration of graininess.

These results show that the compounds of the present invention prevent the increase in graininess caused when using the tabular emulsion for the color reversal light-sensitive material, and sharpness is greatly improved without causing an increase in graininess, if the compound of the present invention is used together with the tabular emulsion for the color reversal light-sensitive material.

TABLE 2

| Sample No. | Emulsion coated for high-speed blue-sensitive layer | Compound of the present invention and amount thereof added to high-speed blue-sensitive layer (mol/kg emulsion) |
|---|---|---|
| 101 (Comparative example) | B (Spherical) | — |
| 102 (Comparative example) | A (Tabular) | — |
| 103 (This invention) | A (Tabular) | (I-1) $9 \times 10^{-4}$ |
| 104 (This invention) | A (Tabular) | (I-12) $9 \times 10^{-4}$ |
| 105 (This invention) | A (Tabular) | (I-13) $9 \times 10^{-4}$ |
| 106 (This invention) | A (Tabular) | (I-18) $9 \times 10^{-4}$ |
| 107 (This invention) | A (Tabular) | (I-22) $9 \times 10^{-4}$ |
| 108 (This invention) | A (Tabular) | (II-4) $9 \times 10^{-4}$ |
| 109 (This invention) | A (Tabular) | (III-2) $9 \times 10^{-4}$ |
| 110 (This invention) | A (Tabular) | (III-6) $9 \times 10^{-4}$ |
| 111 (This invention) | A (Tabular) | (IV-8) $9 \times 10^{-4}$ |

TABLE 2-continued

| 112 (This invention) | A (Tabular) | (IV-9) $9 \times 10^{-4}$ | |
|---|---|---|---|
| Relative sensitivity (D = 1.0) | Graininess (D = 1.0) | Sharpness (25 C/mm) Magenta image | Cyan image |
| 100 | 25.4 | 0.59 | 0.41 |
| 112 | 31.1 | 0.64 | 0.52 |
| 101 | 25.6 | 0.63 | 0.52 |
| 104 | 25.3 | 0.65 | 0.54 |
| 97 | 25.2 | 0.64 | 0.53 |
| 102 | 25.7 | 0.66 | 0.54 |
| 107 | 26.0 | 0.61 | 0.51 |
| 110 | 29.7 | 0.63 | 0.52 |
| 106 | 26.2 | 0.60 | 0.50 |
| 105 | 28.5 | 0.65 | 0.54 |
| 98 | 25.3 | 0.66 | 0.50 |
| 105 | 27.0 | 0.62 | 0.51 |

EXAMPLE 2

Sample 201 was prepared in the same manner as Sample 102 of Example 1 except that a spherical emulsion C prepared in the same manner as the emulsion B of Example 1 and spectrally sensitized so as to have green sensitivity was used in the 7th layer (high-speed green-sensitive emulsion layer).

Then, Sample 202 was prepared in the same manner as Sample 201 except that a tabular silver halide grain emulsion D prepared in the same manner as for the emulsion A of Example 1 and spectrally sensitized so as to have green-sensitivity was used in the high-speed green sensitive layer instead of the emulsion C used for the high-speed green-sensitive layer of Sample 201.

Further, Samples 203 to 212 were prepared in the same manner as for Sample 202 except that compounds of the present invention shown in Table 3 were used together with the above described emulsion D for forming the high-speed green-sensitive layer.

These samples were exposed to light and processed in the same manner as in Example 1 to obtain color images. Graininess and sensitivity of the magenta image and sharpness of the cyan image were measured.

The results obtained are shown in Table 3.

It is understood from Table 3 that Sample 202 wherein the tabular emulsion D was used in the high-speed green-sensitive layer had remarkably improved sharpness and high sensitivity as compared with Sample 201 wherein the spherical emulsion C was used in the high-speed green-sensitive layer. However, graininess of this sample was inferior to the comparative sample 201.

In contrast in Samples 203 to 212 wherein the compounds of the present invention were used together with the tabular emulsion D in the high-speed green-sensitive layer, sharpness and sensitivity were improved without causing an increase in graininess.

TABLE 3

| Sample No. | Emulsion coated for high-speed green-sensitive layer | Compound of the present invention and amount thereof added to high-speed green-sensitive layer (mol/kg emulsion) |
|---|---|---|
| 201 (Comparative example) | C (Spherical) | — |
| 202 (Comparative example) | D (Flat) | — |
| 203 (This invention) | D (Flat) | (I-1) $9 \times 10^{-4}$ |
| 204 (This invention) | D (Flat) | (I-12) $9 \times 10^{-4}$ |
| 205 (This invention) | D (Flat) | (I-13) $9 \times 10^{-4}$ |
| 206 (This invention) | D (Flat) | (I-18) $9 \times 10^{-4}$ |

TABLE 3-continued

| | | | |
|---|---|---|---|
| 207 (This invention) | D (Flat) | (I-22) $9 \times 10^{-4}$ | |
| 208 (This invention) | D (Flat) | (II-4) $9 \times 10^{-4}$ | |
| 209 (This invention) | D (Flat) | (III-2) $9 \times 10^{-4}$ | |
| 210 (This invention) | D (Flat) | (III-6) $9 \times 10^{-4}$ | |
| 211 (This invention) | D (Flat) | (IV-8) $9 \times 10^{-4}$ | |
| 212 (This invention) | D (Flat) | (IV-9) $9 \times 10^{-4}$ | |
| Relative sensitivity (D = 1.0) | Graininess (D = 1.0) | Sharpness of Cyan image (25 C/mm) | |
| 100 | 14.2 | 0.49 | |
| 135 | 18.5 | 0.58 | |
| 113 | 15.0 | 0.57 | |
| 115 | 14.3 | 0.59 | |
| 107 | 14.1 | 0.57 | |
| 110 | 15.3 | 0.58 | |
| 127 | 16.0 | 0.58 | |
| 131 | 17.6 | 0.56 | |
| 120 | 16.4 | 0.57 | |
| 117 | 14.2 | 0.57 | |
| 111 | 14.7 | 0.58 | |
| 123 | 16.1 | 0.59 | |

EXAMPLE 3

Tabular silver halide emulsions E to G were prepared in the same manner as the emulsion A of Example 1 except that the amount of thioether contained in the Solution IV in Table 1 and the reaction temperature were different.

The ratio of diameter/thickness (which is the value at which the total projected area of grains having a ratio of diameter/thickness higher than this value occupies 50% of the total projected area of all the grains) of the resulting emulsions is shown in Table 4.

Then, Samples 301 to 304 were prepared in the same manner as Sample 102 in Example 1, except that the comparative spherical emulsion H and tabular emulsions E to G prepared in the same manner as for the emulsion B of Example 1 were used to form the 10th layer (high-speed blue-sensitive emulsion layer) instead of the emulsion A of Example 1.

Further, Samples 305 to 308 were prepared in the same manner as the Samples 302 to 304 except that compound (I-12) of the present invention was used in an amount shown in Table 4 together with the tabular emulsions E to F to form the 10th layer (high-speed blue-sensitive emulsion layer).

The samples obtained were exposed to light and processed in the same manner as in Example 1 to obtain color images. Graininess and sensitivity of the yellow image and the sharpness of magenta and cyan images of the processed samples were measured in the same manner as in Example 1.

The results obtained are shown in Table 4.

It is understood from Table 4 that Samples 302 to 304 wherein tabular emulsions E to G were used respectively in the high-speed blue-sensitive layer have remarkably improved sharpness as compared with Sample 301 wherein the spherical emulsion H was applied as the high-speed blue sensitive layer. However, the graininess of these samples is inferior to that of the comparative samples 301.

In contrast, in Samples 305 to 308, wherein the tabular emulsion and the compound of the present invention were used together for forming the high-speed blue-sensitive layer, graininess was improved. It is understood that graininess of the samples having a relatively low "ratio of diameter/thickness" (Samples 305 and 306) was improved to a degree equal to comparative sample 301, but the effect of improving graininess is somewhat smaller in the sample having a high "ratio of diameter/-thickness" (Sample 307). However, it is understood that graininess of grains having such a comparatively high "ratio of diameter/thickness" (namely, a larger surface area per unit weight) is restored to that of the comparative samples when the amount of the compound of the present invention is increased as in Sample 308. However, in this case, some deterioration of sensitivity is observed. These results indicate that it is necessary to add a large amount of the compound of the present invention in order to improve graininess while preventing dissolution of grains, because the solubility of grains in case of development processing increases with the increase of the "ratio of diameter/thickness" of tabular grains.

As described above, the combination of the tabular silver halide grains and the compound of the present invention together for forming a color reversal light-sensitive material is very effective for improving sensitivity, sharpness and graininess. However, in order to provide all of sensitivity, sharpness and graininess, the tabular silver halide grains are preferred to have a "ratio of diameter/thickness" of about 4 to 7.

TABLE 4

| Sample No. | Emulsion coated for high-speed blue-sensitive layer | "Ratio of diameter/thickness"* | Compound of the present invention and amount thereof added to high-speed blue-sensitive layer (mol/kg emulsion) | | Relative sensitivity (D = 1.0) | Graininess (D = 1.0) | Sharpness (25 C/mm) Magenta image | Sharpness (25 C/mm) Cyan image |
|---|---|---|---|---|---|---|---|---|
| 301 (Comparative example) | H (Spherical) | — | — | | 100 | 25.3 | 0.60 | 0.42 |
| 302 (Comparative example) | E (Tabular) | 4 | — | | 110 | 30.1 | 0.64 | 0.51 |
| 303 (Comparative example) | T (Tabular) | 6 | — | | 113 | 31.3 | 0.67 | 0.56 |
| 304 (Comparative example) | G (Tabular) | 9 | — | | 111 | 32.5 | 0.67 | 0.57 |
| 305 (This invention) | E (Tabular) | 4 | (I-12) | $9 \times 10^{-4}$ | 103 | 25.2 | 0.65 | 0.50 |
| 306 (This invention) | F (Tabular) | 6 | (I-12) | $9 \times 10^{-4}$ | 104 | 25.4 | 0.68 | 0.57 |
| 307 (This invention) | G (Tabular) | 9 | (I-12) | $9 \times 10^{-4}$ | 104 | 28.1 | 0.67 | 0.56 |
| 308 (This invention) | G (Tabular) | 9 | (I-12) | $13 \times 10^{4}$ | 82 | 25.4 | 0.67 | 0.57 |

*Defined in this specification.

EXAMPLE 4

Onto a triacetate film support were coated the following first to third layers in the order listed below to prepare a sample.

The 1st layer: Tabular silver halide emulsion layer 1 kg of a tabular silver halide emulsion which was not subjected to chemical sensitization and spectral sensitization (which was a silver iodobromide emulsion containing 98 g of silver and 70 g of gelatin and having an iodine content of 2.5 mol %, wherein the average diameter of grains was 0.92 μm and the total projected area of grains having a ratio of diameter/thickness of 5.8 or more occupied 50% of the total projected area of the whole grains) was mixed with 700 g of a 14% aqueous solution of gelatin until dissolved. To the mixed solution, the compound of the present invention was added in the amount shown in Table 5, and 70 cc of a 1% aqueous solution of compound (V-1) was added as a stabilizer, and as a coating aid was added thereto. The mixture was applied so as to result in a dry film thickness of 2.7 μm (silver amount: 1.6 g/m$^2$).

The 2nd layer: Colloidal silver emulsion layer 1 kg of a colloidal silver emulsion having a grain size of 0.008 to 0.010 μm (containing 8.9 g of silver and 67 g of gelatin) was mixed with a 14% aqueous solution of gelatin, and a coating aid was added thereto. The mixture was applied so as to result in a dry film thickness of 1 μm (silver amount: 0.01 g/m$^2$).

The 3rd layer: Protective layer

A 14% solution of gelatin, water and a gelatin hardener (1,4-bis(vinylsulfonylacetamido)ethane) were mixed, and a coating aid was added thereto. The mixture was applied so as to result in a dry film thickness of 1.9 μm.

These samples were processed with a developing solution having the following composition at 38° C. for 6 minutes or 10 minutes without previously being exposed to light.

| Composition of developing solution: | |
|---|---|
| Water | 700 ml |
| Nitrilo-N,N,N—trimethylene phosphonic acid.5Na salt | 2 g |
| Sodium sulfite | 20 g |
| Hydroquinone monosulfonate.potassium salt | 30 g |
| Sodium carbonate (monohydrate) | 30 g |
| 1-Phenyl-4-methyl-4-hydroxymethyl-3-pyrazolidone | 2 g |
| Potassium bromide | 2.5 g |
| Potassium iodide (0.1% solution) | 2 ml |
| Thioether compound (shown in Table 1) | |
| Water to make | 1000 ml |

After development, they were washed with water for 2 minutes. After they were processed with a fixing solution having the following composition for 4 minutes, they were washed with water and dried.

| Fixing solution: | |
|---|---|
| Water | 800 ml |
| Ammonium thiosulfate | 80.0 g |
| Sodium sulfite | 5.0 g |
| Sodium bisulfite | 5.0 g |
| Water to make | 1000 ml |

The silver amount in these processed samples was measured. The results obtained by measurement of the silver amount shows the amount of silver halide in the 1st layer subjected to solution physical development by means of colloidal silver in the 2nd layer as centers of solution physical development. That is, what the silver halide in the 1st layer is subjected to solution physical development means that the silver halide is dissolved whereby the developed silver is deposited on as a nucleus the colloidal silver of the 2nd layer which is not a silver halide but a silver grain (metallic silver). The amount of silver deposited can be measured as the difference in silver amount before and after the development (i.e., since the silver halide is not metallic silver, the amount thereof is never included in the measured amount). The results obtained are shown in Table 5.

It is understood from Table 5 that the silver amount in Samples 402 to 422 to which the compounds of the present invention were added is small as compared with the comparative sample 401. Particularly, a remarkable effect is produced in Samples 402 to 413 wherein the compounds represented by the general formula (I) were added.

As shown by these results, the compounds of the present invention improve graininess by restraining the solution physical development of tabular silver halide grains. It is understood from Table 5 that a sufficient effect is obtained when the amount of the invention compounds is about $3\times10^{-4}$ mols per mol of silver. Generally the effect increases with increase of the amount of invention compounds added. However, an optimum amount of the invention compounds is in a range of about $10^{-4}$ to $10^{-2}$ mol per mol of tabular silver halide, because deterioration of photographic sensitivity is caused by adding a greater amount of the compounds of the present invention.

TABLE 5

| Sample No. | Silver amount coated ($\mu g/cm^2$) | Compound added to emulsion | Amount of compound added (mol per mol of silver halide) | Developed silver amount in the 1st development time of 6 minutes ($\mu g/cm^2$) | Developed silver amount in the 1st development time of 10 minutes ($\mu g/cm^2$) |
|---|---|---|---|---|---|
| 401 | 160 | — | — | 47.0 | 69.3 |
| 402 | 160 | (I-1) | $3\times10^{-4}$ | 42.5 | 65.4 |
| 403 | 160 | (I-1) | $6\times10^{-4}$ | 39.5 | 60.5 |
| 404 | 160 | (I-1) | $1.2\times10^{-3}$ | 36.0 | 52.5 |
| 405 | 160 | (I-12) | $3\times10^{-4}$ | 46.0 | 63.9 |
| 406 | 160 | (I-12) | $6\times10^{-4}$ | 44.3 | 60.9 |
| 407 | 160 | (I-12) | $1.2\times10^{-3}$ | 37.4 | 54.5 |
| 408 | 160 | (I-17) | $3\times10^{-4}$ | 40.5 | 55.9 |
| 409 | 160 | (I-17) | $6\times10^{-4}$ | 34.2 | 48.2 |
| 410 | 160 | (I-17) | $1.2\times10^{-3}$ | 27.2 | 40.1 |
| 411 | 160 | (I-18) | $3\times10^{-4}$ | 43.8 | 62.4 |
| 412 | 160 | (I-18) | $6\times10^{-4}$ | 40.3 | 60.9 |
| 413 | 160 | (I-18) | $1.2\times10^{-3}$ | 38.5 | 55.2 |
| 414 | 160 | (II-4) | $3\times10^{-4}$ | 44.3 | 66.4 |
| 415 | 160 | (II-4) | $6\times10^{-4}$ | 43.2 | 65.3 |
| 416 | 160 | (II-4) | $1.2\times10^{-3}$ | 40.2 | 60.2 |
| 417 | 160 | (III-1) | $3\times10^{-4}$ | 45.9 | 68.4 |
| 418 | 160 | (III-1) | $6\times10^{-4}$ | 44.4 | 66.0 |
| 419 | 160 | (III-1) | $1.2\times10^{-3}$ | 43.5 | 65.4 |
| 420 | 160 | (IV-4) | $3\times10^{-4}$ | 45.9 | 69.0 |
| 421 | 160 | (IV-4) | $6\times10^{-4}$ | 44.7 | 68.1 |
| 422 | 160 | (IV-4) | $1.2\times10^{-3}$ | 44.6 | 66.3 |

While the invention has been described in detail and with reference to specific embodiments thereof, it will be apparent to one skilled in the art that various changes and modifications can be made therein within departing from the spirit and scope thereof.

What is claimed is:

1. In a method for developing a silver halide color reversal light-sensitive material after imagewise exposing which comprises at least a first black-and white development and a subsequent color development, wherein during the first development silver halide in the silver color reversal light-sensitive material is subjected to solution physical development, the improvement wherein the solution physical development is controlled by the presence of at least one compound represented by the later presented general formulae (I) to (IV), said silver halide color reversal light-sensitive material comprising a support having thereon at least one red-sensitive emulsion layer, at least one green-sensitive emulsion layer and at least one blue-sensitive emulsion layer, at least one layer of said light-sensitive material comprising (1) an emulsion containing tabular silver halide grains having a diameter/thickness ratio of at least about 4 and (2) at least one compound represented by the following general formulae (I) to (IV), said tabular silver halide grains being present in amount of at least about 50% of the total projected area of silver halide grains present in the same layer:

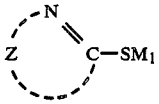

(I)

wherein $M_1$ represents a hydrogen atom, a cation or a group cleavable in alkaline conditions, and Z represents an atomic group necessary to form a 5-membered or 6-membered heterocycle, a substituted 5-membered or 6-membered heterocycle or a condensed ring containing a 5-membered or 6-membered heterocycle;

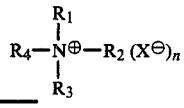

(II)

wherein $R_1$, $R_2$, $R_3$ and $R_4$, which may be the same or different, each represents an alkyl group, an aryl group or an aralkyl group (and the total number of carbon atoms in $R_1$ to $R_4$ is 20), provided that $R_1$, $R_2$ and $R_3$ may combine to form a heterocycle containing a quaternary nitrogen atom or $R_1$ and $R_2$ may combine to form a group containing a double bond bonded to the nitrogen atom and then form together $R_3$ a nitrogen-containing ring, $X^{\ominus}$ represents an anion, and n is 1 or is 0 when the compound forms an inner salt;

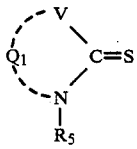

(III)

wherein $R_5$ represents a substituted or unsubstituted alkyl group, a substituted or unsubstituted aralkyl group, a substituted or unsubstituted alkenyl group, a substituted or unsubstituted aryl group or a substituted or unsubstituted heterocyclic group, V represents O, S, Se or $NR_6$ wherein $R_6$ represents an alkyl group, an aralkyl group, an alkenyl group, an aryl group or a heterocyclic group, which may be the same or different from $R_5$, and $Q_1$ represents an atomic group necessary to form a 5-membered or 6-membered heterocycle or a condensed ring containing a 5-membered or 6-membered heterocycle; and

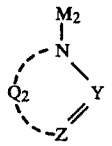

(IV)

wherein Y and Z, which may be the same or different, each represents a methine group, a substituted methine group or a nitrogen atom, $Q_2$ represents an atomic group necessary to form a 5-membered or 6-membered heterocycle or a condensed ring containing a 5-membered or 6-membered heterocycle, and $M_2$ represents a hydrogen atom or a cation selected from an alkali metal cation and an ammonium ion.

2. A method as claimed in claim 1, wherein said compound is represented by the general formula (I), (III) or (IV).

3. A method as claimed in claim 1, wherein said compound is represented by the general formula (I).

4. A method as claimed in claim 1, wherein $M_1$ represents a hydrogen atom, a cation or a group cleavable in alkaline conditions which is selected from the group consisting of —COR', —COOR', —$CH_2CH_2COR'$, —$CH_2CH_2CN$, and —$CH_2CH_2SO_2CH_3$, wherein R' represents a hydrogen atom, an alkyl group, an aralkyl group or an aryl group, and the heterocycle moiety including Z is selected from the group consisting of tetrazole, triazole, imidazole, oxazole, thiadiazole, pyridine, pyrimidine, triazine, azabenzimidazole, purine, tetrazaindene, triazaindene, pentazaindene, benzotriazole, benzimidazole, benzoxazole, benzothiazole, benzoselenazole and naphthoimidazole, said heterocycle being unsubstituted or substituted with an alkyl group, an alkenyl group, an aralkyl group, an aryl group, an arylthio group, an alkylthio group, an aralkylthio group or mercapto group, provided that when the heterocycle contains a condensed ring, it may be additionally substituted by a nitro group, an amino group, a halogen atom, a carboxyl group or a sulfo group.

5. A method as claimed as claimed in claim 1, wherein the compound of general formula (II) is represented by the following general formula (IIa):

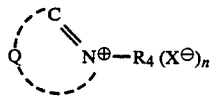

(IIa)

wherein Q represents a quaternary nitrogen containing heterocycle, a quaternary nitrogen containing heterocycle substituted with a substituent selected from the group consisting of an alkyl group, an alkenyl group, an aralkyl group, an aryl group, an alkylthio group, an arylthio group and aralkylthio group, or Q represents a condensed ring containing a quaternary nitrogen containing heterocycle, or a condensed ring containing a quaternary nitrogen containing heterocycle substituted with a substituent selected from the group consisting of an alkyl group, an alkenyl group, an aralkyl group, an aryl group, an alkylthio group, an arylthio group, an aralkylthio group, a nitro group, an amino group, a halogen atom, a carboxyl group and a sulfo group, and $R_4$, X and n each has the same definition as in formula (II).

6. A method as claimed in claim 1, wherein in general formula (III) the alkyl group represented by $R_5$ and $R_6$ contains about 1 to 20 carbon atoms and is unsubstituted or substituted with a halogen atom, a cyano group, a carboxyl group, a hydroxy group, an acyloxy group containing about 2 to 6 carbon atoms, an alkoxycarbonyl group containing about 2 to 22 carbon atoms, a carbamoyl group, a sulfamoyl group, a sulfo group, an amino group, or a substituted amino group;

the aralkyl group represented by $R_5$ and $R_6$ is a benzyl group or a phenethyl group;

the alkenyl group represented by $R_5$ and $R_6$ is an allyl group;

the aryl group represented by $R_5$ and $R_6$ is a binuclear aryl group, a mononuclear aryl group or a substituted mononuclear aryl group substituted with an alkyl group containing about 1 to 20 carbon atoms, an alkoxy group, a halogen atom containing about 1 to 20 carbon atoms, a carboxyl group, or a sulfo group; and the heterocycle containing $Q_1$ is a heterocycle selected from the group consisting of a thiazoline ring, a thiazolidine ring, a selenazoline ring, an oxazoline ring, an oxazolidine ring, an imidazolidine ring, an imidazolidine ring, a 1,3,4-thiadiazoline ring, a 1,3,4-oxadiazoline ring, a 1,3,4-triazoline ring, a tetrazoline ring and a pyrimidine ring, or the heterocycle containing $Q_1$ is condensed with a 5- to 7-membered carbocycle or heterocycle which is unsubstituted or substituted with the same substituents as defined for the aryl group represented by $R_5$ and $R_6$, an alkylthio group, an amino group, a substituted amino group, an acylamino group, a sulfonamido group, a thioamido group, an alkenyl group containing about 2 to 20 carbon atoms, an aralkyl group having 1 to 4 carbon atoms in the alkyl moiety, a cyano group, a carbamoyl group, an alkoxycarbonyl group containing about 2 to 22 carbon atoms or an alkylcarbonyl group containing about 2 to 22 carbon atoms.

7. A method as claimed in claim 1, wherein in general formula (IV) the heterocycle containing $Q_2$ is selected from the group consisting of triazole, tetrazole, imidazole, oxazole, thiadiazole, pyridine, pyrimidine, triazine, azabenzimidazole, purine, tetrazaindene, triazaindene, pentazaindene, benzotriazole, benzimidazole, benzoxazole, benzothiazole, benzoselenazole, indazole and naphthoimidazole, said heterocycle being unsubstituted or substituted with a substituent selected from the group consisting of an alkyl group, an alkenyl group, an aralkyl group, an aryl group, an alkylthio group, an arylthio group and an aralkylthio group, provided that when said heterocycle contains a condensed ring, it may be additionally substituted by a nitro group, an amino group, a halogen atom, a carboxyl group or a sulfo group.

8. A method as claimed in claim 1, wherein said compound represented by general formulae (I) to (IV) is contained in the same layer as the tabular silver halide grains, the total amount of the compound represented by general formulae (I) to (IV) being from about $10^{-5}$ to $10^{-1}$ mol per mol of the tabular silver halide grains.

9. A method as claimed in claim 8, wherein the total amount of the compound represented by general formula (I) to (IV) is from about $10^{-4}$ to $10^{-2}$ mol per mol of the tabular silver halide grains.

10. A method as claimed in claim 1, wherein at least one layer of said material further comprises at least one compound represented by the following general formulae (V) or (VI):

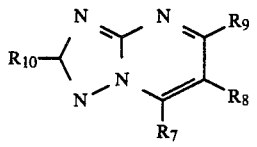

General formula (V)

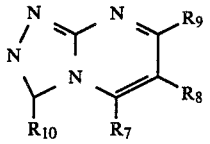

General formula (VI)

wherein $R_7$, $R_8$, $R_9$ anbd $R_{10}$, which may be the same or different, each represents a hydrogen atom, an unsubstituted or substituted alkyl group containing about 1 to 20 carbon atoms, an unsubstituted monocyclic or bicyclic aryl group, a substituted monocyclic or bicyclic aryl group, an unsubstituted or substituted amino group, a hydroxy group, an alkoxy group containing about 1 to 20 carbon atoms, an alkylthio group containing about 1 to 6 carbon atoms, a carbomyl group, a carbomyl group substituted with an aliphatic group or an aromatic group, a halogen atom, a cyano group, a carboxyl group, an alkoxycarbonyl group containing about 2 to 20 carbon atoms, or a 5-membered or 6-membered heterocycle, provided that at least one of $R_7$ and $R_9$ represents a hydroxy group and $R_7$ and $R_8$ or $R_8$ and $R_9$ may combine to form a 5-membered or 6-membered ring.

11. A method as claimed in claim 10, wherein $R_{10}$ represents a substituted alkyl group represented by the following general formula (VII):

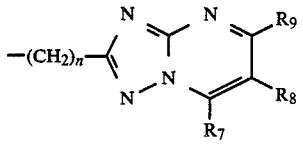

(VII)

wherein $R_7$, $R_8$ and $R_9$ each has the same definition as for general formulae (V) and (VI) and n represents 2 or 4.

12. A method as claimed in claim 1, wherein the tabular silver halide grains have a diameter/thickness ratio of of about 7 or less.

13. A method as claimed in claim 12, wherein the tabular silver halide grains have a diameter/thickness ratio of at least about 5.

14. A method as claimed in claim 13, wherein said emulsion containing tabular silver halide grains further comprises tabular silver halide grains having a diameter/thickness ratio of at least about 8 present in an amount of up to about 50% of the total projected area.

15. A method as claimed in claim 1, wherein said compound is represented by the general formula (II).

16. A as claimed in claim 1, wherein said compound is represented by the general formula (III).

17. A method as claimed in claim 1, wherein said compound is represented by the general formula (IV).

* * * * *